US005834164A

United States Patent [19]

Nakayama et al.

[11] Patent Number: 5,834,164

[45] **Date of Patent: *Nov. 10, 1998**

[54] SILVER HALIDE PHOTOGRAPHIC LIGHT SENSITIVE MATERIAL COMPRISING A COUPLER CAPABLE OF CHELATION AND METHOD FOR FORMING IMAGES BY THE USE THEREOF

[75] Inventors: Noritaka Nakayama; Tatsuo Tanaka; Shigeto Hirabayashi, all of Hino, Japan

[73] Assignee: Konica Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 644,905

[22] Filed: May 10, 1996

[30] Foreign Application Priority Data

May 18, 1995 [JP] Japan ..... 7-119884
Jun. 8, 1995 [JP] Japan ..... 7-141975

[51] Int. Cl.[6] ..... G03C 7/30

[52] U.S. Cl. ..... 430/376; 430/359; 430/386; 430/387

[58] Field of Search ..... 430/359, 386, 430/387, 390, 392, 376

[56] References Cited

U.S. PATENT DOCUMENTS

| | | | |
|---|---|---|---|
| H1593 | 9/1996 | Haraga et al. | 430/507 |
| 5,460,936 | 10/1995 | Kondo et al. | 430/569 |
| 5,462,844 | 10/1995 | Tosaka | 430/558 |
| 5,470,697 | 11/1995 | Kita et al. | 430/558 |
| 5,480,767 | 1/1996 | Tosaka et al. | 430/642 |
| 5,486,450 | 1/1996 | Tosaka et al. | 430/557 |
| 5,492,800 | 2/1996 | Yamagami | 430/627 |
| 5,496,687 | 3/1996 | Kawamoto | 430/939 |
| 5,496,691 | 3/1996 | Miyamoto | 430/640 |
| 5,514,809 | 5/1996 | Kato | 430/576 |
| 5,561,040 | 10/1996 | Kawai et al. | 430/551 |
| 5,597,682 | 1/1997 | Ishii et al. | 430/600 |

*Primary Examiner*—Hoa Van Le
*Attorney, Agent, or Firm*—Frishauf, Holtz, Goodman, Langer & Chick, P.C.

[57] ABSTRACT

An image forming method is disclosed, comprising exposing a silver halide photographic light sensitive material comprising a support having thereon a silver halide emulsion layer containing a dye forming coupler and processing the exposed photographic material, wherein the coupler has, in its molecule, at least two sites capable of chelating with a metal ion to form a 5-membered or 6-membered chelate ring, thereby forming, together with a developing agent and the metal ion, a chelate dye.

16 Claims, No Drawings

SILVER HALIDE PHOTOGRAPHIC LIGHT SENSITIVE MATERIAL COMPRISING A COUPLER CAPABLE OF CHELATION AND METHOD FOR FORMING IMAGES BY THE USE THEREOF

FIELD OF THE INVENTION

The present invention relates to a silver halide photographic light sensitive material comprising a coupler capable of chelation and a method for forming images by the use thereof.

BACKGROUND OF THE INVENTION

In a silver halide color photographic light sensitive material (hereinafter, simply referred to as "light sensitive material"), there are generally used a silver halide light sensitive emulsion and a dye forming coupler which reacts with an oxidized developing agent to form a dye.

As a cyan coupler, there have been employed phenols and naphthols, as described in U.S. Pat. Nos. 2,369,929 and 2,474,293.

However, a cyan dye image obtained from phenols or naphthols have problems in color reproduction. Thus, the absorption spectrum of these cyan dyes is not sharp in the shorter wavelength region and unwanted absorption, i.e. asymmetric absorption, is present in the blue region. To solve this problem, in negative films, the asymmetric absorption has conventionally been corrected by masking with a colored coupler. However, this also resulted in reduction in sensitivity, making it unacceptable. In the case of reversal photographic material and color paper, effective correction means are little known and color reproduction is deteriorated. As a novel cyan coupler having a preferred absorption, a coupler with an imidazole nucleus was proposed in European Patent 249,453. This coupler, however, was insufficient in dye fastness for practical use.

On the other hand, a dye formed from a 5-pyrazolone type coupler, which has been widely employed and studied as a magenta dye image forming coupler, was excellent in heat and light fastness, but it has an asymmetric absorption, which causes color contamination in the yellow color component. To overcome this problem, pyrazolobenzimidazole, indazolone, pyrazolotriazole, imidazopyrazole, pyrazolopyrazole and pyrazolotetrazole type couplers were proposed. In fact, these couplers were preferable from the point of color reproduction. However, the dye formed from these couplers has the problem that image lasting quality is remarkably low and the image is subject to discoloration.

As a means for improving the fastness of these dyes, Japanese Patent examined 4-47811 discloses a technique of bringing an azo or azomethine dye formed on coupling-reaction with a developing agent into contact with a polyvalent metal ion, in which the developing agent and coupler both have a site capable of chelating to form a bidentate or terdentate metal-chelated dye image.

To obtain the thus metal-chelated dye image, the developing agent necessitates having ametal-chelating site. Accordingly, it is not compatible with developing agents which are widely employed at the present time, and is therefore commercially too expensive. The thus metal-chelated dye image was proved to be insufficient in image lasting quality and further improvements are required. In addition, dye formability is insufficient and improvements thereof have been desired.

SUMMARY OF THE INVENTION

Accordingly, an object of the present invention is to provide a silver halide photographic light sensitive material sufficiently improved in image fastness and an image forming method by the use thereof.

Another object is to provide a silver halide photographic light sensitive material containing a coupler capable of forming a chelate dye, which is excellent in spectral-absorption characteristics, such a cyan dye having a sharp absorption edge in the short wavelength side and no asymmetric absorption in the green region and blue region, and magenta dye having a sharp absorption and no asymmetric absorption in the blue region.

Another object is to means for forming an image by the use of conventionally used developing agent.

Another object is to provide a silver halide photographic light sensitive material comprising a novel coupler capable of forming a chelate dye upon coupling reaction with a developing agent and an image forming method by the use thereof.

Another object is to provide a processing method for forming an image by processing a light sensitive material comprising a novel coupler capable of forming a chelated dye upon coupling reaction with a developing agent with a processing solution containing a metal ion.

Another object is to provide a novel, metal-chelated coupler capable of forming a metal chelated dye upon coupling reaction with a developing agent.

The above objects can be accomplished by a silver halide photographic light sensitive material comprising a support having thereon a silver halide emulsion layer containing a coupler, wherein said coupler is capable of forming a dye upon oxidative coupling with a developing agent including a salt thereof, which has, in the molecule, at least two sites capable of chelating with a metal ion to form a 5-membered or 6-membered chelate ring, thereby said coupler forming a metal-chelate dye along with said developing agent and the metal ion; and an image forming method comprising exposing said silver halide photographic light sensitive material and subjecting the exposed photographic material to photographic processing.

DETAILED DESCRIPTION OF THE INVENTION

A developing agents usable in the present invention are those suitable for photographic use. The developing agent is preferably represented by the following formula (CD).

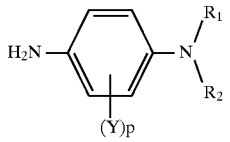

Formula (CD)

In the formula, $R_1$ and $R_2$ independently represent an alkyl group, which may be substituted. As examples thereof are cited methyl, ethyl, hydroxyethyl and methanesulfonamidoethyl. Y is a group substitutable for a benzene ring, such as an alkyl group, alkoxy group or acylamino group, among which an alkyl group is preferable and more preferably methyl. In the case where Y is located at the position adjacent to an amino group (—$NH_2$), Y is an alkyl group. p is an integer of 0 to 4, and when p is 2 or more, a plurality of p may be the same or different from each other. $R_1$ and $R_2$ may be combined with each other to form a ring, or each may be combined with Y to form a ring.

Exemplary examples of the compound are shown as below, but the present invention is not limited thereto.

CD-1

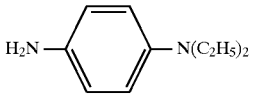

CD-2

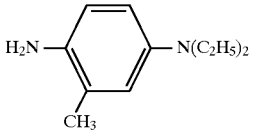

CD-3

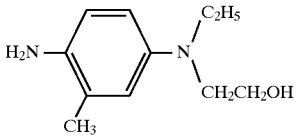

CD-4

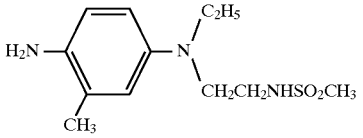

CD-5

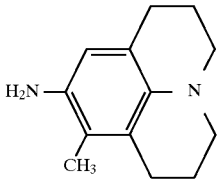

CD-6

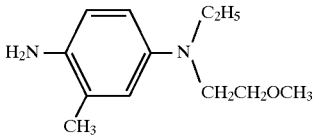

CD-7

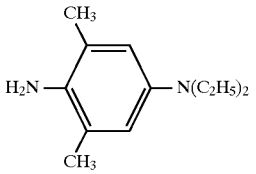

CD-8

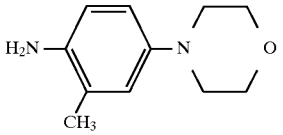

CD-9

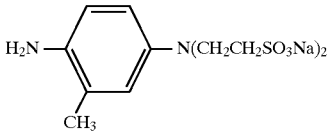

CD-10

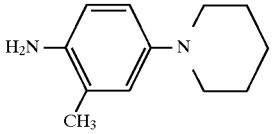

-continued

CD-11

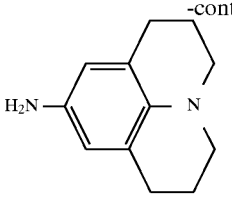

CD-12

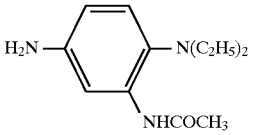

Another developing agent is preferably represented by the following formula (PCD).

Formula (PCD)

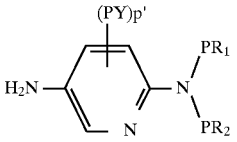

In the formula, $PR_1$ and $PR_2$ independently are an alkyl group, which may be substituted. PY is a group substitutable for a pyridine ring, Provided that, when located at the position adjacent to an amino group (—$NH_2$), PY is an alkyl group. p' is an integer of 0 to 4, and when p' is 2 or more, a plurality of p's are the same or different from each other. Exemplary examples of the compounds are shown as below.

PCD-1

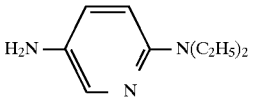

PCD-2

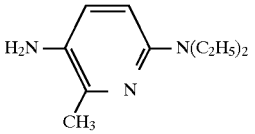

PCD-3

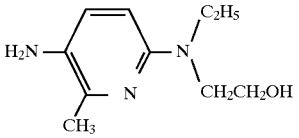

PCD-4

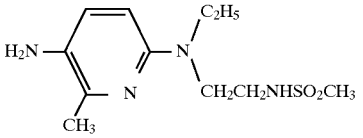

PCD-5

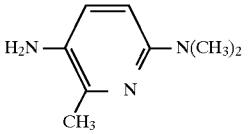

PCD-6

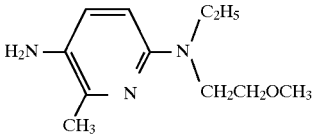

-continued

PCD-7

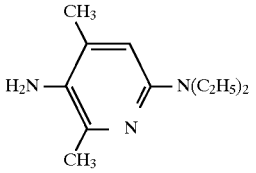

PCD-8

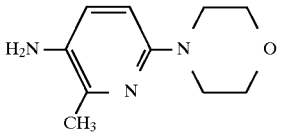

PCD-9

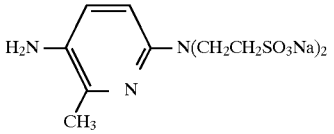

PCD-10

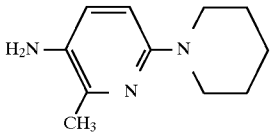

As the couple of the present invention is preferably used a compound represented by the following formula (I).

Formula (I)

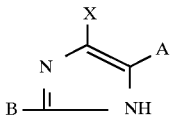

In the formula, A and B independently represent a substituent for an imidazole ring. The substituent includes an alkyl group, which may be substituted (i.e., methyl, ethyl, propyl, i-propyl methoxymethyl, etc.) ,an aryl group, which maybe substituted (i.e., phenyl, 3-methoxyphenyl, 3- or 4-acylaminophenyl, 3- or 4-sulfonamidophenyl, etc.), a heterocyclic group (e.g., pyrazolyl, pyridyl, etc.) and an electron-attracting group (cyano, ethoxycarbonyl, carbamoyl, sulfamoyl, dicyanovinyl, etc.). At least one of A and B is a chelating group, which is capable of forming a chelate with a metal ion. As the chelating group is cited a group containing an atom having an unshared electron pair such as a nitrogen, oxygen or sulfur atom (e.g.,., amino, imino, ether, alcohol. thioether, thiol, pyrrol, pyridyl, furyl, thiofuryl, etc.) . The chelating group is located at such a position as to be able to form, together with any of nitrogen atoms included in the imidazole ring and a metal ion, a 5-membered or 6-membered metal chelate ring.

X represents a hydrogen atom or a group capable of being released upon coupling reaction with an oxidized product of a developing agent.

In the formula (I), a preferable compound is represented by the following formula (Ia) or (Ib).

Formula (Ia)

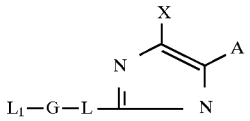

Formula (Ib)

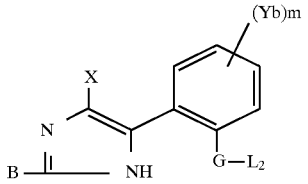

In formula (Ia), A and X each have the same definition as that of A and X of formula (I). G represents a chelating group capable of forming a metal chelate. The chelating group has the same definition as that of the chelate group of formula (I). $L_1$ represents a hydrogen atom or a substituent capable of bonding to G; L represents a substituent for the imidazole ring; and L and $L_1$ may combine with each other to form a 5- or 6-membered ring. A is preferably an aromatic hydrocarbon ring, an aromatic heterocyclic ring or an electron-attracting group.

In formula (Ib), B and X each have the same definition as that of B and X of formula (I); G has the same definition as that of G of formula (I). $L_2$ represent a hydrogen atom or a substituent capable of bonding to G; $Y_b$ represents a substituent for a benzene ring. M is an integer of 0 to 4, and when m is 2 or more, a plurality of $Y_b$ may be the same or different. B is preferably an aromatic hydrocarbon ring, an aromatic heterocyclic ring or an electron-attracting group.

Exemplary examples thereof are shown as below, but the present invention is not limited thereto.

I-1

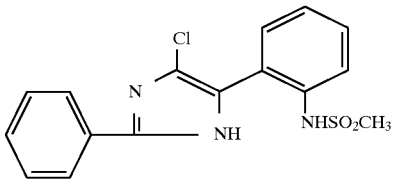

I-2

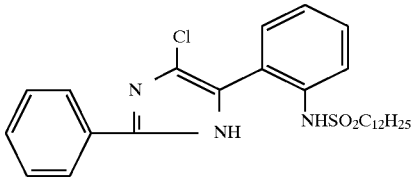

-continued
I-3
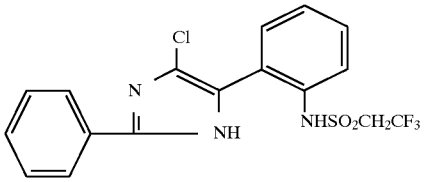
I-4
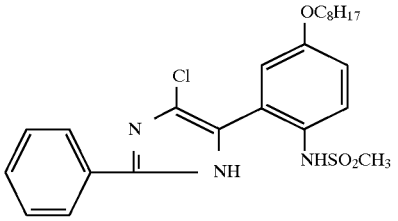
I-5
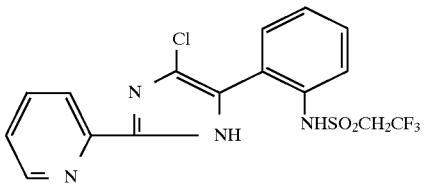
I-6
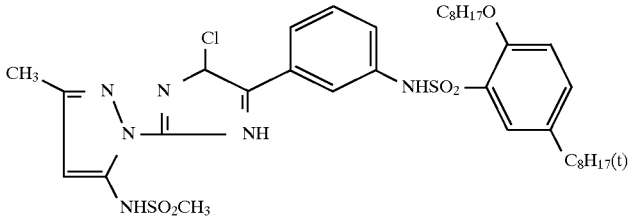
I-7
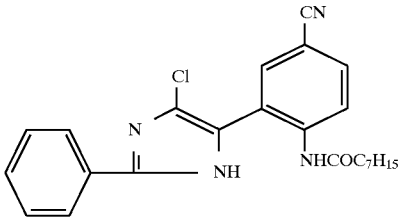
I-8
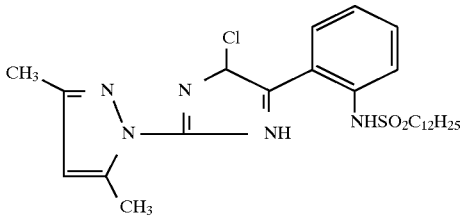
I-9
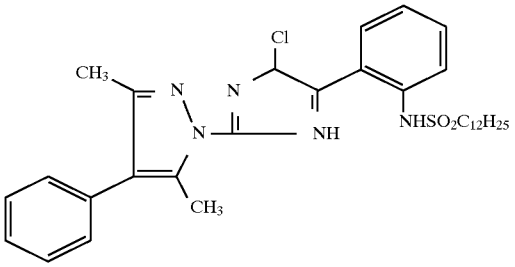

-continued
I-10
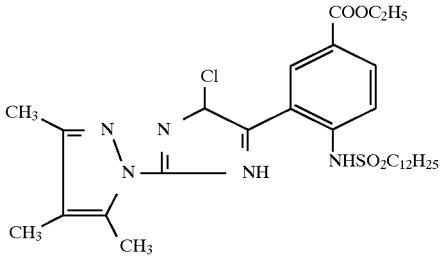
I-11
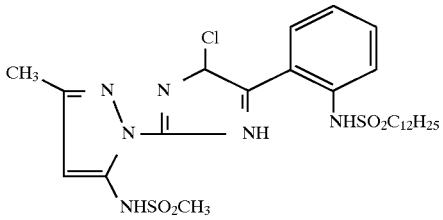
I-12
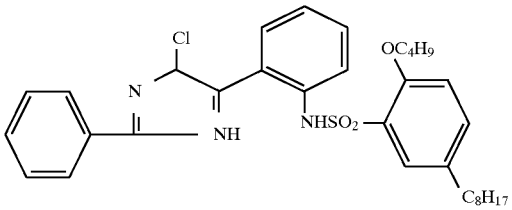
I-13
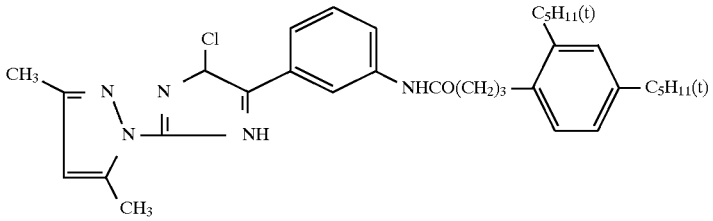
I-14
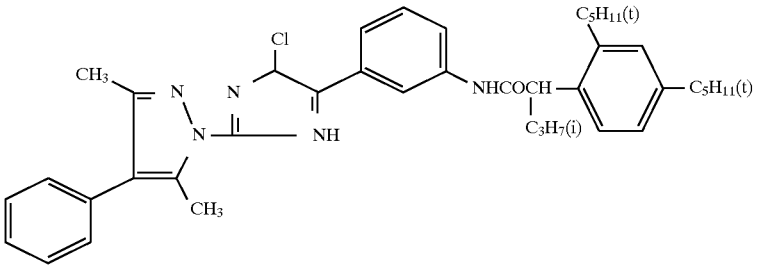
I-15
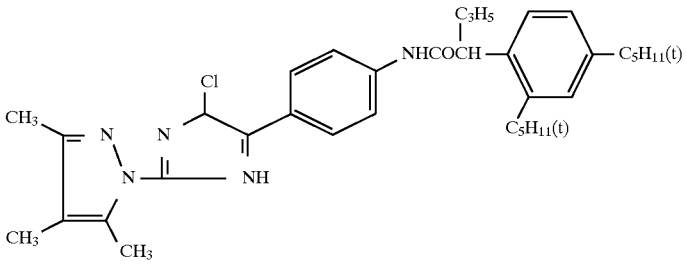

-continued
I-16
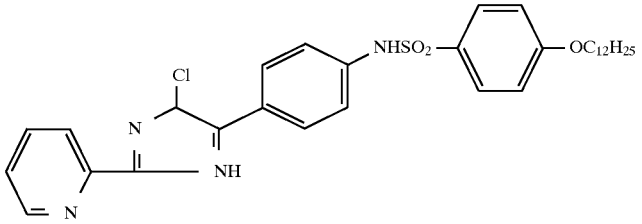
I-17
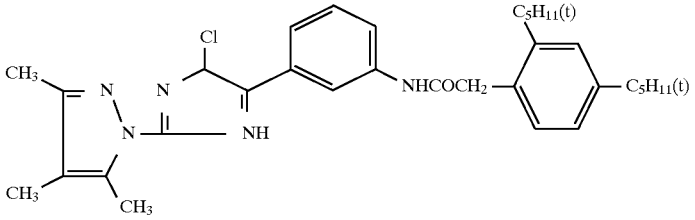
I-18
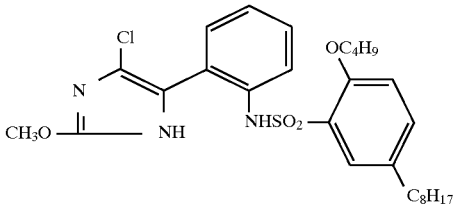
I-19
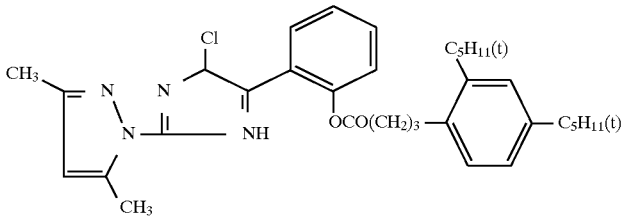
I-20
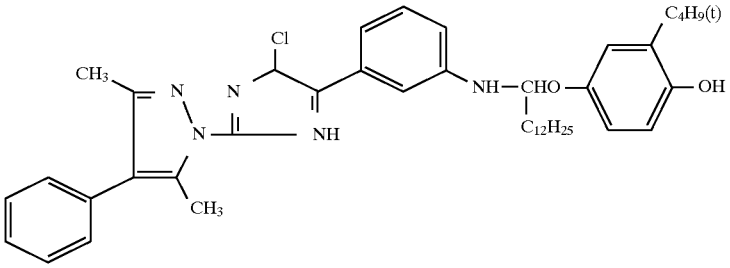
I-21
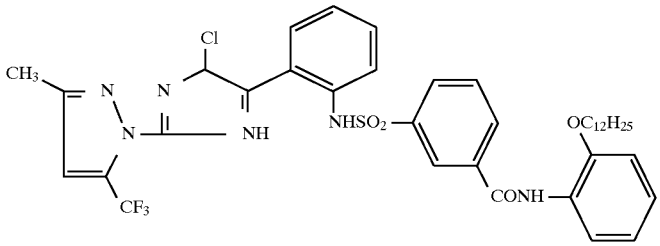
I-22
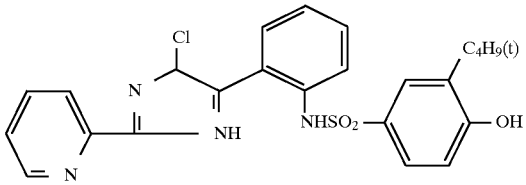

-continued

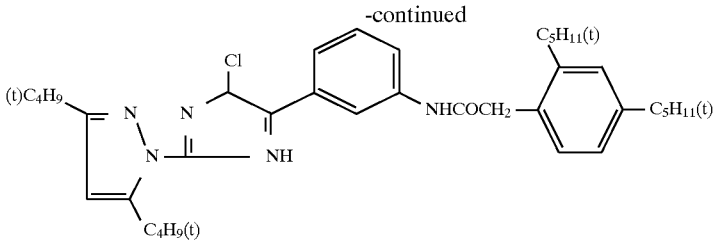

I-23

As the coupler of the invention is preferably used a compound represented by the following formula (II).

Formula (II)

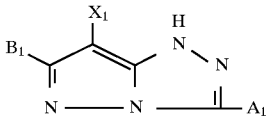

In the formula, $A_1$ and $B_1$ each represent a substituent for a pyrazolotriazole ring. The substituent includes an alkyl group, which may be substituted (e.g., methyl, ethyl propyl, i-propyl, methoxymethyl, benzyl, etc.); an aryl group, which may be substituted (e.g., phenyl, 3-methylphenyl, etc.); and a heterocyclic group (imidazolyl, pyridyl, etc.). At least one of $A_1$ and $B_1$ is a chelating group, which is chelatable with a metal ion. As the chelating group is cited a group containing an atom having an unshared electron pair such as a nitrogen, oxygen or sulfur atom (e.g., amino, imino, ether, alcohol. thioether, thiol, pyrrol, pyridyl, furyl, thiofuryl, etc.). The chelating group is located at such a position as to be able to form, together with any of nitrogen atoms included in the pyrazolotriazole ring and a metal ion, a 5- or 6-membered metal chelate ring.

$X_1$ represents a hydrogen atom or a group capable of being released upon coupling reaction with an oxidized developing agent.

Exemplary examples thereof are shown as below, but the present invention is not limited thereto.

II-1

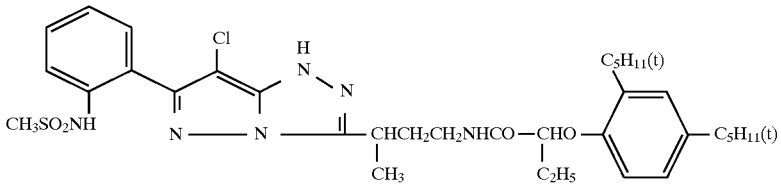

II-2

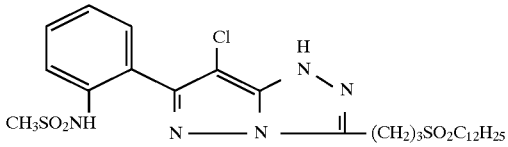

II-3

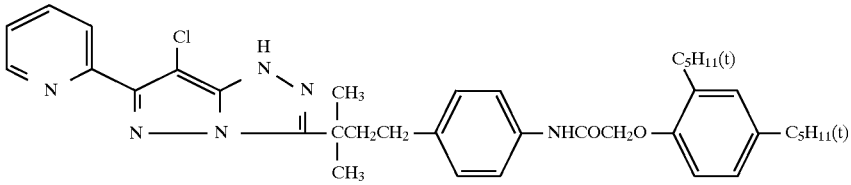

II-4

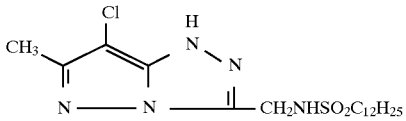

II-5

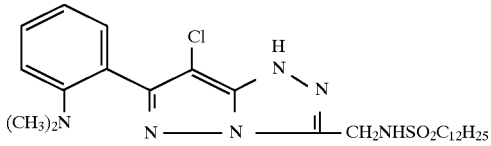

-continued

II-6

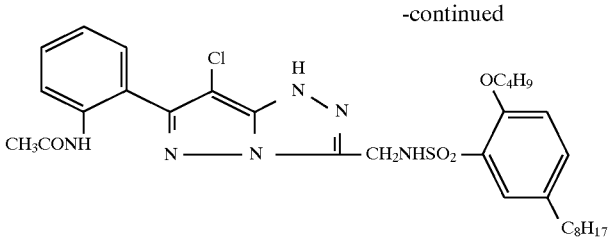

II-7

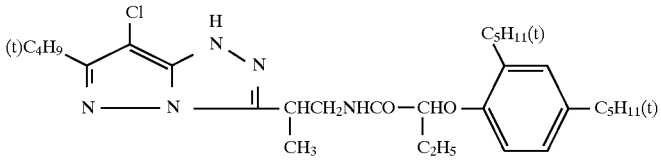

II-8

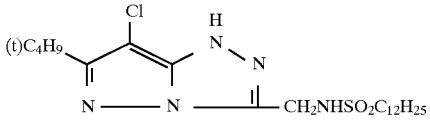

I-9

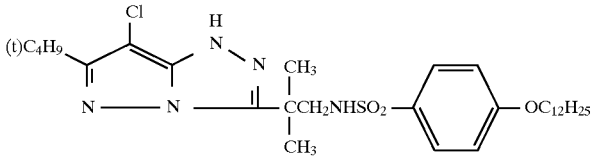

II-10

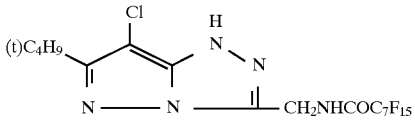

II-11

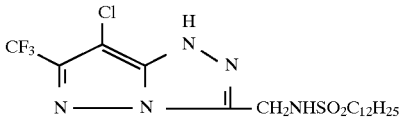

I-12

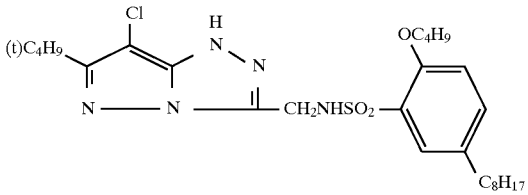

II-13

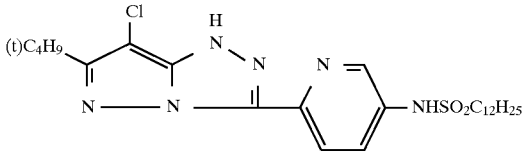

As the coupler of the invention is preferably used a compound represented by the following formula (III).

Formula (III)

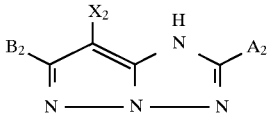

In the formula, $A_2$ and $B_2$ each represent a substituent for a pyrazolotriazole ring. The substituent includes an alkyl group, which may be substituted (e.g., methyl, ethyl propyl, i-propyl, methoxymethyl, benzyl, etc.); an aryl group, which may be substituted (e.g., phenyl, 2-sulfonamidophenyl, etc.); and a heterocyclic group (pyrazolyl, pyridyl, etc.). At least one of $A_2$ and $B_2$ is a chelating group, which is chelatable with a metal ion. As the chelating group is cited a group containing an atom having an unshared electron pair such as a nitrogen, oxygen or sulfur atom (e.g., amino, imino, ether, alcohol. thioether, thiol, pyrrol, pyridyl, furyl, thiofuryl, etc.). The chelating group is located at such a position as to be able to form, together with any of nitrogen atoms included in the pyrazolotriazole ring and a metal ion, a 5- or 6-membered metal chelate ring.

Exemplary examples thereof are shown as below, but the present invention is not limited thereto.

III-1

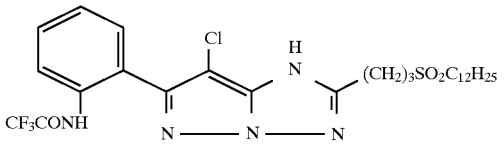

III-2

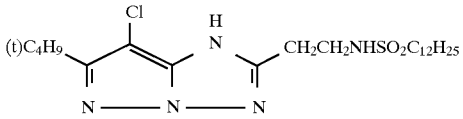

III-3

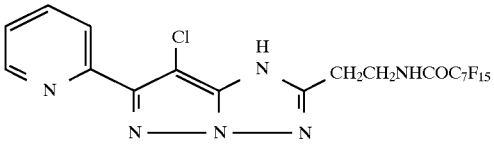

III-4

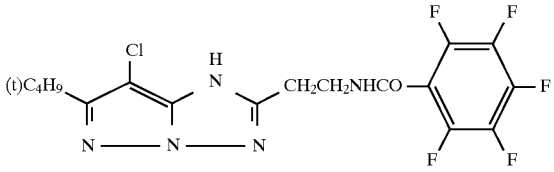

III-5

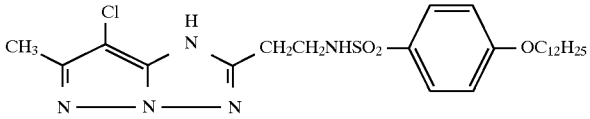

III-6

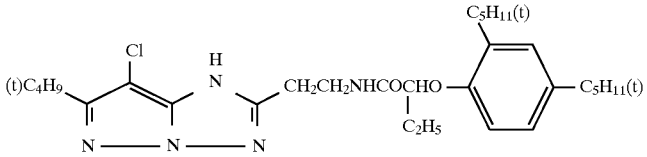

As the coupler of the invention is preferably used a compound represented by the following formula (IV)

Formula (VI)

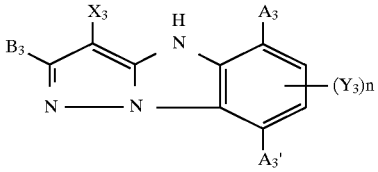

In the formula, $A_3$, $A_3'$ and $B_3$ each represent a substituent for a pyrazolobenzimidazole ring. The substituent includes an alkyl group, which maybe substituted (e.g., methyl, ethyl propyl, i-propyl, methoxymethyl, etc.); an aryl group, which may be substituted (e.g., phenyl, tolyl, etc.); and a heterocyclic group (pyrazolyl, pyridyl, etc.). At least one of $A_3$, $A_3'$ and $B_3$ is a chelating group, which is chelatable with a metal ion. The chelating group is located at such a position as to be able to form, together with any of nitrogen atoms included in the pyrazolobenzimidazole ring and a metal ion, a 5- or 6-membered metal chelate ring. $X_3$ represents a hydrogen atom or a group capable of being released upon coupling reaction with an oxidized developing agent. $Y_3$ represents a substituent for a benzene ring; n is an integer of 0 to 2 and when n is 2, two $Y_3$s may be the same or different.

Exemplary examples thereof are shown as below, but the present invention is not limited thereto.

IV-1

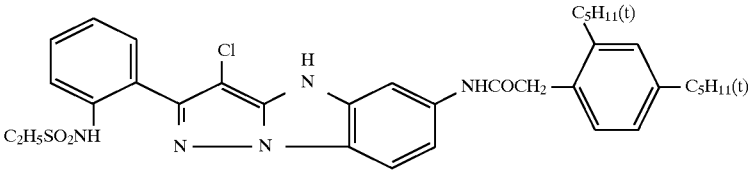

-continued

IV-2

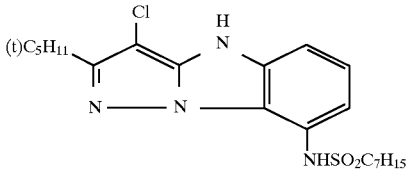

IV-3

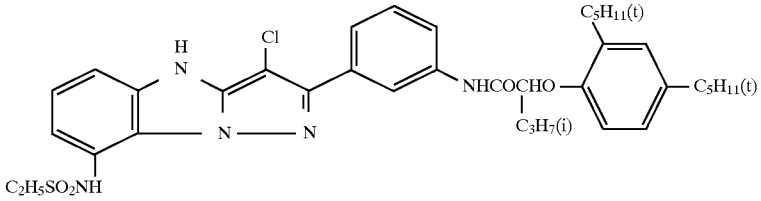

IV-4

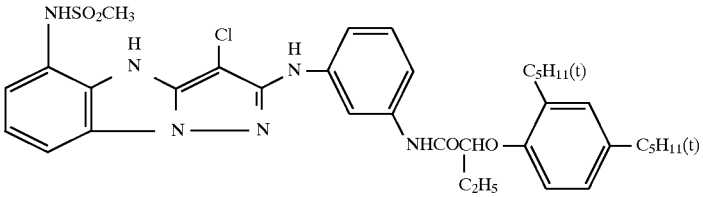

IV-5

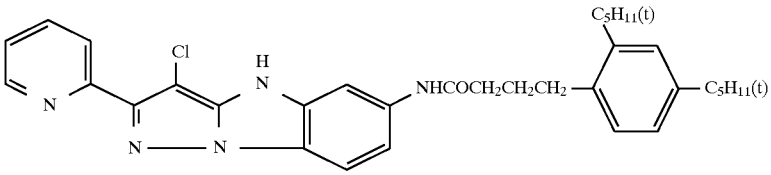

IV-6

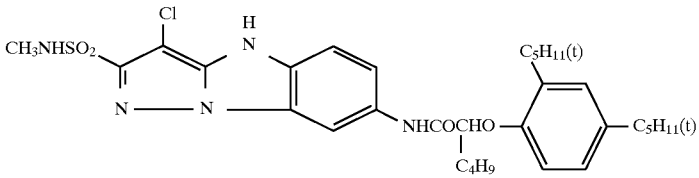

As the coupler of the invention is preferably used a compound represented by the following formula (V).

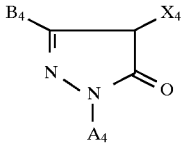

Formula (V)

In the formula, $A_4$ and $B_4$ each represent a substituent for a pyrazolone ring. The substituent includes an alkyl group, which may be substituted (e.g., methyl, ethyl propyl, i-propyl, methoxymethyl, etc.); an aryl group, which may be substituted (e.g., phenyl, 2,4,6-trichlorophenyl, etc.); and a heterocyclic group (pyrazolyl, pyridyl, etc.). At least one of $A_4$ and $B_4$ is a chelating group, which is chelatable with a metal ion. The chelating group is located at such a position as to be able to form, together with any of nitrogen atom and oxygen atom included in the pyrazolone ring and a metal ion, a 5- or 6-membered metal chelate ring.

$X_4$ represents a hydrogen atom or a group capable of being released upon coupling reaction with an oxidized developing agent.

Exemplary examples thereof are shown as below, but the present invention is not limited thereto.

V-1

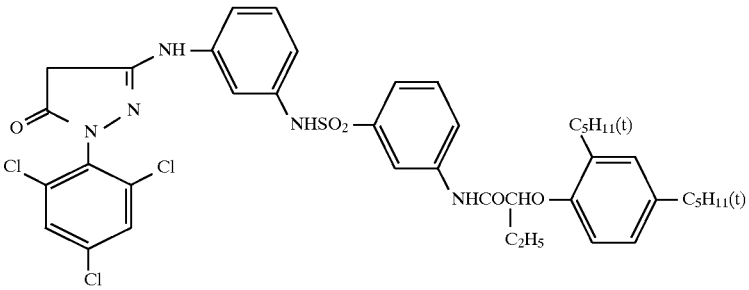

-continued

V-2

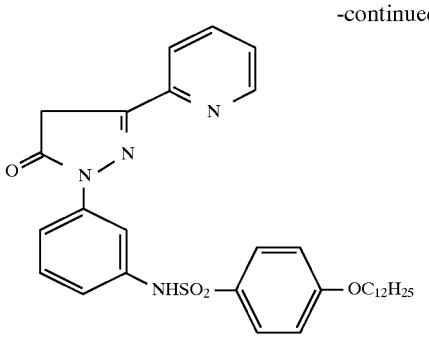

V-3

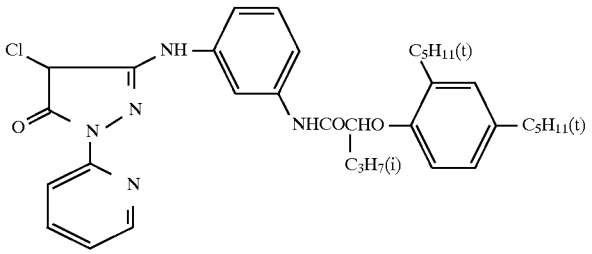

V-4

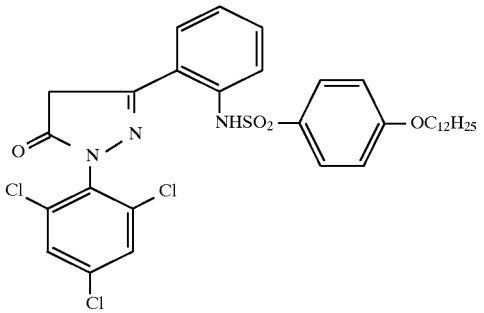

As the coupler of the invention is preferably used a compound represented by the following formula (VI).

Formula (VI)

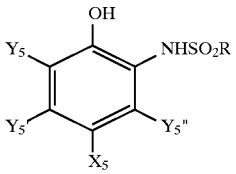

In the formula, R represents an alkyl group, an aryl group or a heterocyclic group. $Y_5$, $Y_5$' and $Y_5$" each represent a substituent for a benzene ring. The substituent includes an alkyl group, which may be substituted (e.g., methyl, ethyl propyl, i-propyl, methoxymethyl, etc.); an aryl group, which may be substituted (e.g., phenyl, methoxyphenyl, etc.); and a heterocyclic group (pyrazolyl, pyridyl, etc.). $Y_5$ and $Y_5$' may combine with each other to form a 5- or 6-membered ring.

$X_5$ represents a hydrogen atom or a group capable of being released upon coupling reaction with an oxidized developing agent.

Exemplary examples thereof are shown as below, but the present invention is not limited thereto.

VI-1

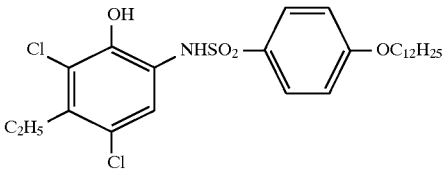

VI-2

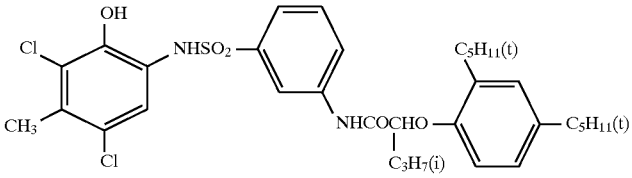

-continued
(VI-3)
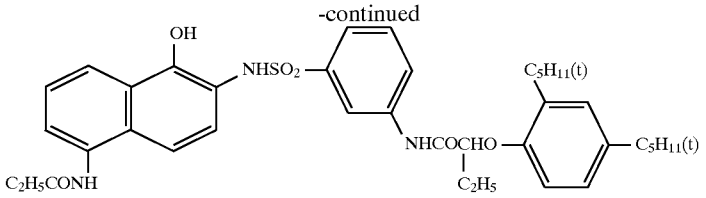
VI-4
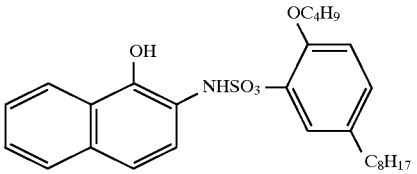
(VI-5)
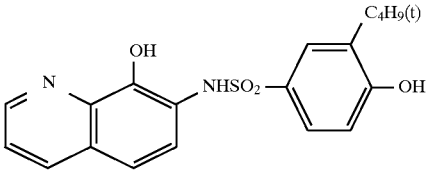
(VI-6)
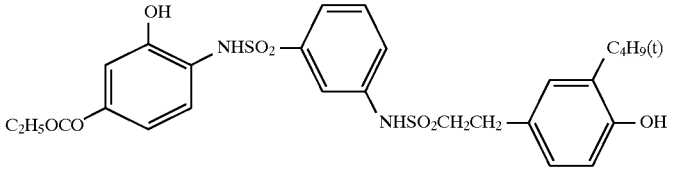
VI-7
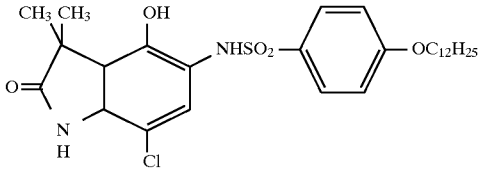
VI-8
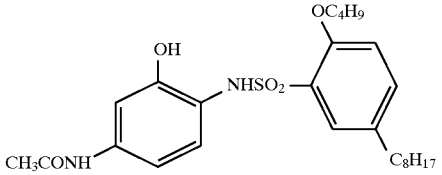
VI-9
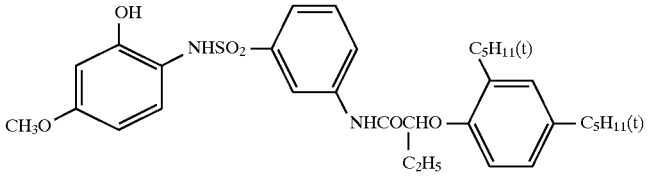
VI-10
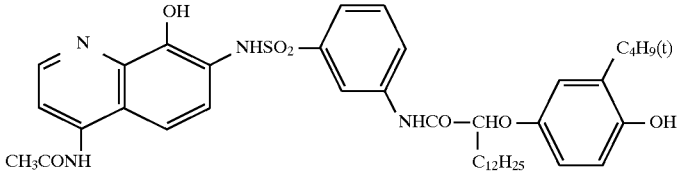
VI-11
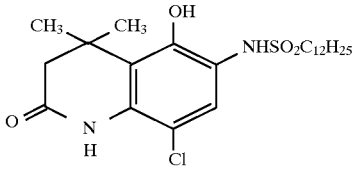

As the coupler of the invention is preferably used a compound represented by the following formula (VII).

Formula (VIII)

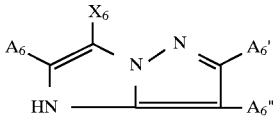

In the formula, $A_6$, $A_6'$ and $A_6''$ each represent a substituent for a pyrazoloimidazole ring. The substituent includes an alkyl group, which may be substituted (e.g., methyl, ethyl propyl, i-propyl, methoxymethyl, benzyl, etc.); an aryl group, which may be substituted (e.g., phenyl, 3-methylphenyl, etc.); and a heterocyclic group (imidazolyl, pyridyl, etc.). At least one of $A_6$, $A_6'$ and $A_6''$ is a chelating group, which is chelatable with a metal ion. The chelating group is located at such a position as to be able to form, together with any of nitrogen atoms included in the pyrazoloimidazole ring and a metal ion, a 5- or 6-membered metal chelate ring. $X_6$ represents a hydrogen atom or a group capable of being released upon coupling reaction with an oxidized developing agent.

Exemplary examples thereof are shown as below, but the present invention is not limited thereto.

As the coupler of the invention is preferably used a compound represented by the following formula (VIII).

Formula (VIII)

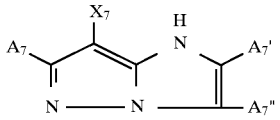

In the formula, $A_7$, $A_7'$ and $A_7''$ each represent a substituent for a pyrazoloimidazole ring. The substituent includes an alkyl group, which may be substituted (e.g., methyl, ethyl propyl, i-propyl, methoxymethyl, benzyl, etc.); an aryl group, which may be substituted (e.g., phenyl, 3-methylphenyl, etc.); and a heterocyclic group (imidazolyl, pyridyl, etc.). At least one of $A_7$, $A_7'$ and $A_7''$ is a chelating group, which is chelatable with a metal ion. The chelating group is located at such a position as to be able to form, together with any of nitrogen atoms included in the pyrazolotriazole ring and a metal ion, a 5- or 6-membered metal chelate ring. $X_1$ represents a hydrogen atom or a group capable of being released upon coupling reaction with an oxidized developing agent.

Exemplary examples thereof are shown as below, but the present invention is not limited thereto.

VII-1

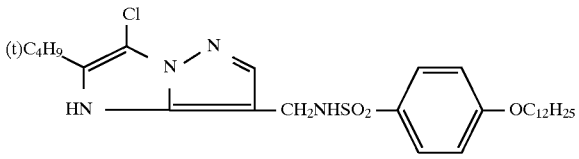

VII-2

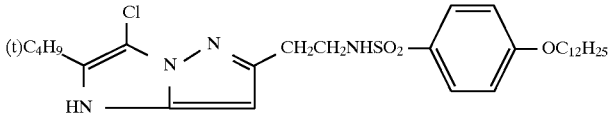

VII-3

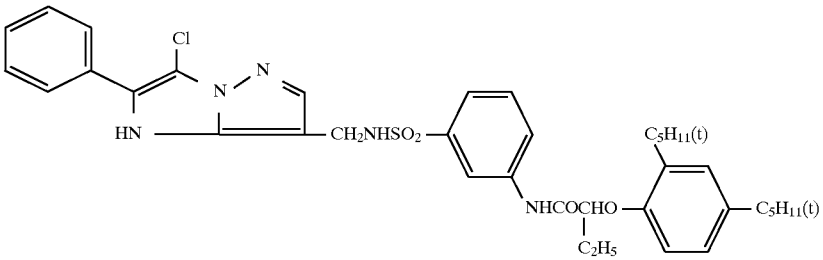

VII-4

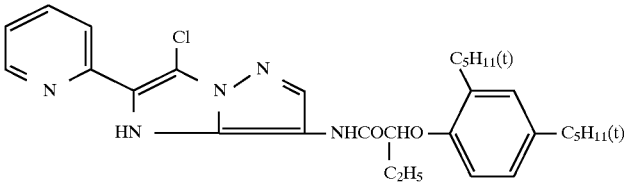

VIII-1
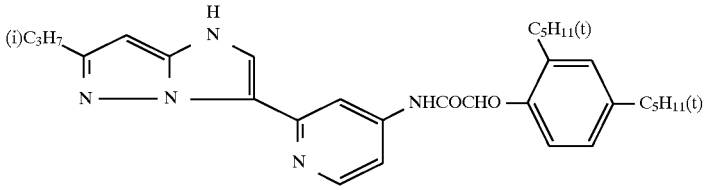
VIII-2
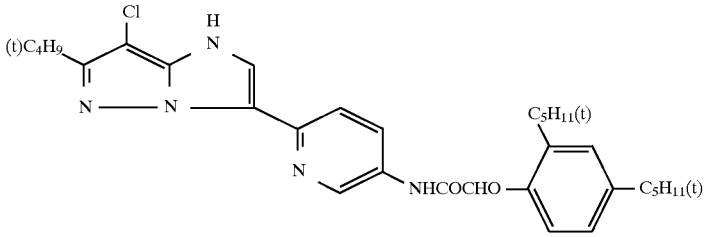
VIII-3
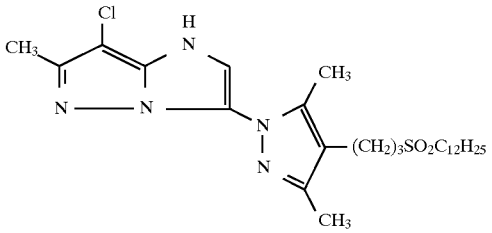
VIII-4
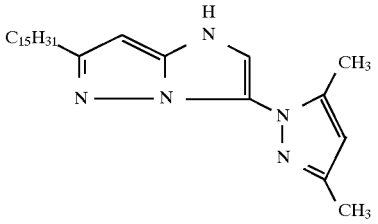
VIII-5
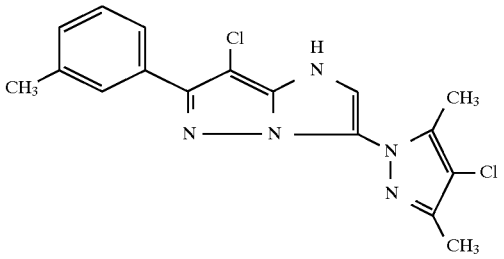
VIII-6
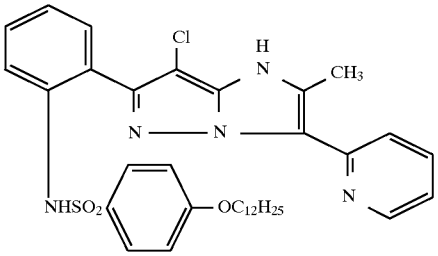
VIII-7
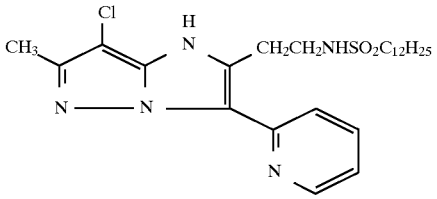

-continued

VIII-8

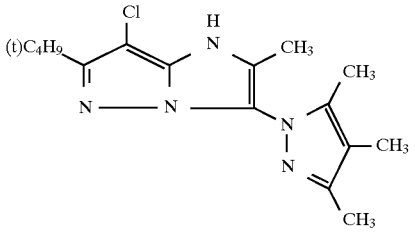

VIII-9

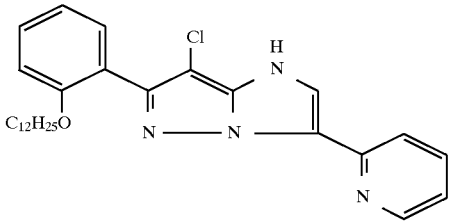

VIII-10

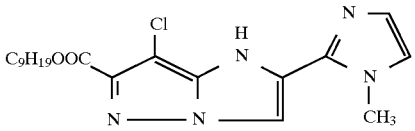

VIII-11

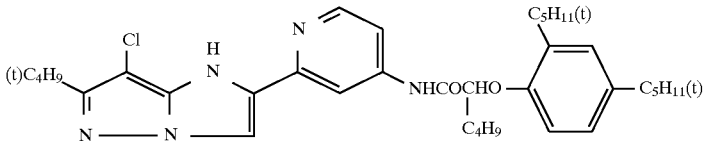

VIII-12

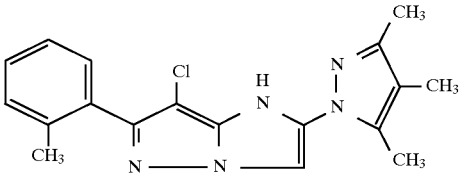

VIII-13

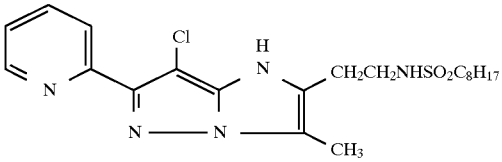

The couplers used in the present invention can be readily synthesized according to known methods, with reference to the following literature.

Compound represented by formula (I) : JP-A 63-22 6653 (the term, "JP-A", referred to an "unexamined published Japanese Patent Application"), 2-155693, 1-110565, 2-668, 2-28264, 2-53865, 2-53866, European Patent 436736.

Compound represented by formula (II) or (III) : British Patent 1,252,418, JP-A64-63194, 2-208094, 3-205189, 2-265791, 2-310087, 2-53866.

Compound represented by formula (IV) : JP-A 4-91987

Compound represented by formula (V) : JP-A 63-205288, 3-226750, British Patent 1183515.

Compound represented by formula (VI) : U.S. Pat. No. 2,369,929, 2,474,293.

Compound represented by formula (VII) : JP-A 4-190348

Compound represented by formula (VIII) : JP-A 63-113077, 3-275767, 4-13774, 4-89287.

The coupler of the invention alone can form a chelate with a metal ion. Chelation of the metal ion shifts its maximum absorption wavelength by 5 nm or more. With respect to exemplary couplers of the invention, the difference between the maximum absorption wavelength in methanol or acetone and its metal chelate is shown as below. The measurement was conducted in such a manner that a coupler of 1 g was dissolved in 1000 cc of methanol or acetone, and metal ions was added thereto in an equimolar amount to the coupler.

| Coupler | Metal ion providing compound | Wavelength difference between before and after chelation (nm) | Solvent |
|---|---|---|---|
| I-8 | MS-8 | 46 | MeOH |
| " | MS-10 | 49 | " |
| " | MS-5 | 43 | " |
| I-13 | MS-8 | 6 | $(Me)_2CO$ |
| I-13 | MS-1 | 56 | $(Me)_2CO$ |
| II-13 | MS-8 | 59 | " |
| " | MS-12 | 69 | " |
| VIII-1 | MS-8 | 60 | " |
| Comp-a | MS-8 | 0 | " |
| Comp-b | MS-8 | 1 | " |
| Comp-c | MS-8 | 0 | " |

Comp-a

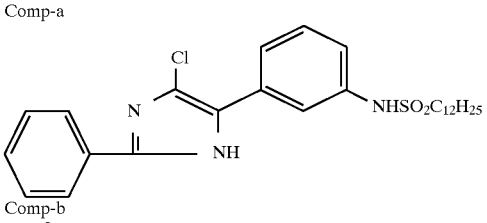

Comp-b

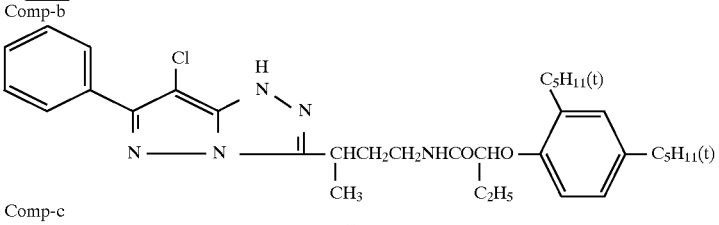

Comp-c

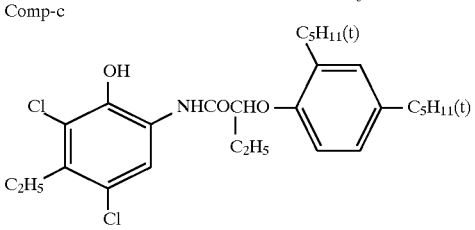

In the invention, a metal ion-containing compound (i.e., metal ion-providing compound) usable for forming a metal chelated dye includes organic or inorganic metal ion salts and metal ion complexes, preferably, a metal salt of a organic acid and a metal ion complex. As metals are cited mono- or poly-valent metals belonging to Groups I through VIII in the periodical table. Among these are preferable Al, Co, Cr, Cu, Fe, Mg, Mn, Mo, Ni, Sn, Ti and Zn; and are more preferable Ni, Cu, Cr, Co and Zn.

As examples of the metal ion containing compounds is cited a $Ni^{2+}$, $Cu^{2+}$, $Cr^{2+}$, $Co^{2+}$ or $Zn^{2+}$ salt of an aliphatic acid such as acetic acid or stearic acid, or aromatic acid such as benzoic acid or salicylic acid.

A complex represented by the following formula (M) is preferably usable.

$$\{M(Q_1)_s(Q_2)_t(Q_3)_u\}^{r+}(T^-)_r \qquad \text{Formula (M)}$$

In the formula, M represents a metal ion, preferably, $Ni^{2+}$, $Cu^{2+}$, $Cr^{2+}$, $Co^{2+}$ or $Zn^{2+}$. $Q_1$, $Q_2$ and $Q_3$ each represent a compound capable of forming a coordinate bond with the metal ion represented by M, which maybe the same or different. These compounds can be selected from such coordination compounds as described in "Chelate Science (5) published by Nankodo. $T^-$ represents an organic anion, such as tetraphenyl borate anion or alkylbenzenesulfonic acid anion. s, t and u each represents an integer of 0 to 3, depending on the coordination number of complex above-mentioned such as tetradentate coordination or hexadentate coordination, or the number of ligands of $Q_1$, $Q_2$ and $Q_3$. r represents 1 or 2.

Among the complexes represented by formula (M) is preferable a compound represented by formula (M-1), corresponding to p, q, r=0 in formal (M).

$$M_1^{2+}(w^-)_2 \qquad \text{Formula (M-1)}$$

In the formula, $M_1^{2+}$ represents bivalent transition metal ion and $w^-$ represents a compound capable of forming a complex with a bivalent metal ion, which is represented by the following formula (M-2).

Formula (M-2)

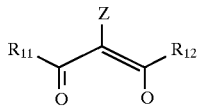

In the formula, Z represents an alkyl group, aryl group, aryloxycarbonyl group, alkoxy group, alkoxycarbonyl group, halogen atom or hydrogen atom. $R_{11}$ and $R_{12}$ each represent an alkyl group or aryl group, which may be the same or different, $R_{11}$ and Z, or $R_{12}$ and Z may be combined with each other to form a ring, provided that, when Z is a hydrogen atom, both $R_{11}$ and $R_{12}$ are not a hydrogen atom at the same time.

Exemplary compounds are shown as below, but the present invention is not limited thereto.

MS-1

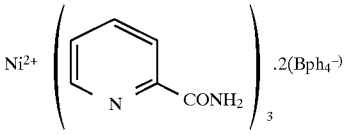

MS-2

$Ni^{2+}(C_2H_5NHCH_2CH_2NH_2)_3.2(Bph_4^-)$

MS-3

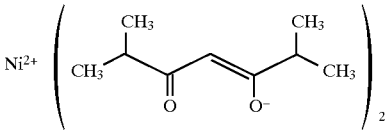

MS-4

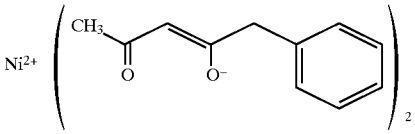

MS-5

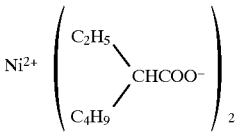

MS-6

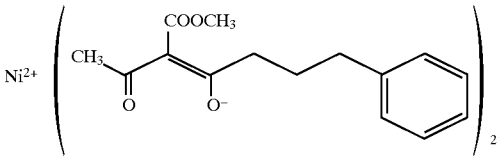

MS-7

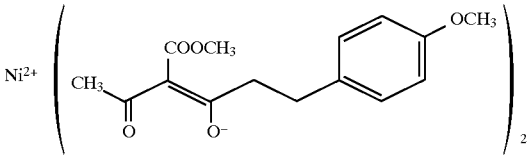

MS-8

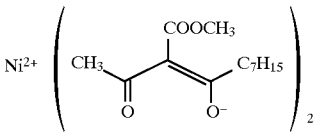

MS-9

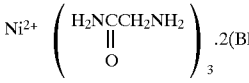

MS-10

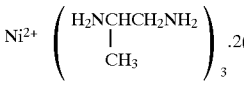

MS-11

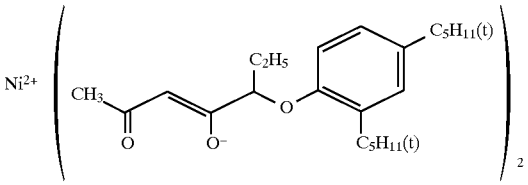

MS-12

$Cu^{2+}(C_2H_5NHCH_2CH_2NH_2)_3.2(BPh_4^-)$

MS-13

$Zn^{2+}(C_2H_5NHCH_2CH_2NH_2)_3.2(BPh_4^-)$

MS-14

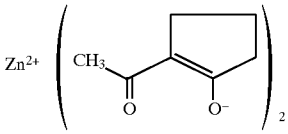

-continued

MS-15

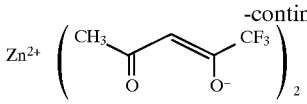

MS-16

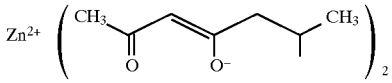

MS-17

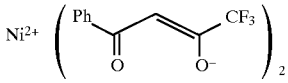

MS-18

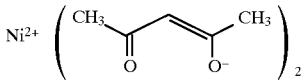

MS-19

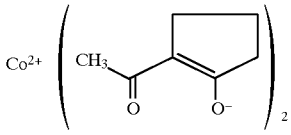

MS-20

$Ni^{2+}(C_{12}H_{43}COO^-)_2$

MS-21

$Ni^{2+}((i)C_{17}H_{35}COO^-)_2$

MS-22

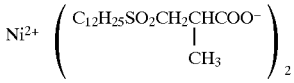

A silver halide color photographic material of the present invention is subjected to imagewise exposure and development. In the invention, a metal-chelated image can be formed by bring the coupler into contact with a metal ion capable of forming chelate prior to, during or after the development. One preferred mode of forming the metal-chelated image is to process the photographic light sensitive material containing the coupler in a solution containing a metal ion containing compound. This solution may be a color developing solution itself or another processing solution subsequently usable, such as an alkaline fixing solution or a metal-chelating solution. Metal chelation is achieved at a pH of 5.0 to 12.0 and at a conventionally-processing temperature.

In the case where a metal ion-containing compound is added into a processing solution, the metal ion-containing compound soluble in the processing solution is selected. In this case, the metal ion-containing compound is added in an amount of 0.1 to 120 g/liter, preferably 1 to 30 g/liter. After developing, the photographic light sensitive material is subjected to bleaching, fixing or bleach-fixing to remove silver or silver halide, washing and drying. Metal chelation is made during the development or any of subsequent processing steps.

As another preferred mode of forming the metal-chelated image in the invention, the image can be obtained by incorporating a metal ion-containing compound (alternatively, metal ion-donating material) in a silver halide emulsion layer containing the coupler of the invention or in another layer.

Another preferred mode of forming the metal-chelated dye image in the invention is to incorporate, in a silver halide emulsion layer, a coupler which has been chelate with a metal ion, i.e. a coupler which is in the form of a metal chelate (hereinafter, this coupler is referred to as a metal-chelated coupler or chelate coupler).

The metal-chelated coupler can be obtained by the reaction of a coupler having a chelating group with a metal ion containing compound.

With regard to the synthesis of the metal-chelated coupler, examples thereof are shown as below, but the present invention is not limited thereto.

EXAMPLE 1

Synthesis of Nickel Chelate of Coupler Compound (I-8)

Compound (I-8) of 5.19 g was dissolved in methanol of 100 ml and after adding thereto nickel acetate of 2 g, water of 50 ml was further added over a period of 3 hrs. with stirring at a room temperature. Ethyl acetate of 100 ml was added and the reaction product was extracted. After drying with magnesium sulfate, solvents were removed by distillation. The resulting residue was subjected to column chromatography treatment using silica gel (developing solvent: ethyl acetate/hexane=1/1) to obtain amorphous product of 4.2 g.

Maximum absorption wavelength of the coupler;

Before reaction, 311 nm (in methane)

After reaction, 357 nm (in methanol)

The product was suggested to be an intended material from its NMR spectrum.

EXAMPLE 2

Synthesis of Nickel Chelate of Coupler Compound (II-12)

Compound (II-12) of 5.16 g was dissolved in methanol of 100 ml and after adding thereto nickel stearate of 3 g, water of 50 ml was further added over a period of 3 hrs. with stirring at a room temperature. Ethyl acetate of 100 ml was added and the reaction product was extracted. After drying with magnesium sulfate, solvents were removed by distillation. The resulting residue was subjected to column chromatography treatment using silica gel (developing solvent: ethyl acetate/hexane=1/1) to obtain amorphous product of 3.2 g. The product was suggested to be an intended material from its NMR spectrum.

EXAMPLE 3

Synthesis of Nickel Chelate of Coupler Compound (III-2)

Compound (III-2) of 4.38 g was dissolved in acetone of 100 ml and after adding thereto nickel acetylacetate of 2 g, water of 50 ml was further added over a period of 1 hr. with stirring at a room temperature. The acetone solution was added dropwise to water of 1000 ml. Ethyl acetate of 200 ml was added thereto and the reaction product was extracted. After drying with magnesium sulfate, solvents were removed by distillation. The resulting residue was subjected to column chromatography treatment using silica gel (developing solvent: ethyl acetate/hexane=1/1) to obtain amorphous product of 2.8 g. The product was suggested to be an intended material from its NMR spectrum.

EXAMPLE 4

Synthesis of Nickel Chelate of Coupler Compound (IV-2)

Compound (IV-2) of 4.03 g was dissolved in methanol of 100 ml and after adding thereto nickel acetylacetate of 2 g, water of 50 ml was further added over a period of 3 hrs. with stirring at a room temperature. Ethyl acetate of 100 ml was added and the reaction product was extracted. After drying with magnesium sulfate, solvents were removed by distillation. The resulting residue was subjected to column chromatography treatment using silica gel (developing solvent: ethyl acetate/hexane=1/1) to obtain amorphous product of 2.9 g. The product was suggested to be an intended material by its NMR spectrum.

EXAMPLE 5

Synthesis of Nickel Chelate of Coupler Compound (V-4)

Compound (V-4) of 6.78 g was dissolved in acetone of 200 ml and after adding thereto nickel trisglycineamidonickel tetraborate of 5 g, water of 50 ml was further added over a period of 3 hrs. with stirring at a room temperature. Water of 1000 ml was added with stirring and ethyl acetate of 100 ml was further added thereto, and the reaction product was extracted. After drying with magnesium sulfate, solvents were removed by distillation. The resulting residue was subjected to column chromatography treatment using silica gel (eluate: ethyl acetate/hexane=1/1) to obtain amorphous product of 5.2 g. The product was suggested to be an intended material by its NMR spectrum.

EXAMPLE 6

Synthesis of Zinc Chelate of Coupler Compound (VI-1)

Compound (VI-1) of 4.3 g was dissolved in methanol of 100 ml and after adding thereto zinc chloride of 3 g, water of 50 ml was further added over a period of 3 hrs. with stirring at a room temperature. Ethyl acetate of 100 ml was added and the reaction product was extracted. After drying with magnesium sulfate, solvents were removed by distillation. The resulting residue was subjected to column chromatography treatment using silica gel (eluate: ethyl acetate/hexane=1/1) to obtain amorphous product of 4.2 g. The product was suggested to be an intended material by its NMR spectrum.

EXAMPLE 7

Synthesis of Nickel Chelate of Coupler Compound (VII-1)

Compound (VII-1) of 5.18 g was dissolved in methanol of 100 ml and after adding thereto nickel acetate of 2 g, water of 50 ml was further added over a period of 3 hrs. with stirring at a room temperature. Ethyl acetate of 100 ml was added and the reaction product was extracted. After drying with magnesium sulfate, solvents were removed by distillation. The resulting residue was subjected to column chromatography treatment using silica gel (eluate: ethyl acetate/hexane=1/1) to obtain amorphous product of 4.2 g. The product was suggested to be an intended material by its NMR spectrum.

The coupler of the invention is used in an amount of $\times 10^{-3}$ to 1 mol, preferably $1\times10^{-2}$ to $8\times10^{-1}$ mol per mol of silver halide.

The coupler of the invention can be used in combination with another kind of cyan coupler or magenta coupler.

Methods and techniques which have been employed in conventional dye forming couplers are also applied to the coupler of the invention.

The coupler of the invention is usable as a material for use in any type of color photographic light sensitive materials. As examples thereof are cited nonincorporated-coupler type color forming process and incorporated-coupler type color forming process.

In the case where the coupler is applied to the nonincorporated-coupler type color forming process, the coupler is dissolved in an alkaline aqueous solution or organic solvent (alcohol, etc.) and the solution is added to a developer to be used.

In the case where the coupler is applied to the incorporated-coupler type color forming process, the coupler is incorporated in a photographic light sensitive material. Exemplarily, the coupler is incorporated in a silver halide emulsion and the emulsion is coated on a support to form a photographic light sensitive material.

The coupler of the invention can be used in a color photographic light sensitive material such as a color negative film, positive film and color printing paper.

The color photographic material including a color printing paper may be monocolor use or multicolor use. A multicolor photographic light sensitive material comprises dye image-forming component units having light-sensitivity respectively in three primary color regions of the spectrum. Each component unit is comprised of mono- or multi-layer emulsion layer having light-sensitivity in a spectral region. Component layers of the photographic light sensitive material including the image-forming component units can be arranged in various manners known in the art.

A representative multicolor photographic light sensitive material comprises a support having thereon a cyan dye image-forming component unit comprising a red-sensitive silver halide emulsion layer containing a cyan coupler, a magenta dye image-forming component unit comprising a green-sensitive silver halide emulsion layer containing a magenta coupler and a yellow dye image-forming component unit comprising a blue-sensitive silver halide emulsion layer containing a yellow coupler.

The photographic light sensitive material may be optionally provided with an additional layer, such as a layer containing a metal ion-containing compound, filter layer, interlayer, protective layer or sub-layer.

In the case of using the coupler of the invention, the metal ion-containing compound may be incorporated in the same or different layer from the coupler, or in a processing solution. In the case of using the metal-chelated coupler of the invention, it is not necessary to make contact with the metal ion-containing compound. In this case, the photographic material may be processed with a processing solution containing the metal ion-containing compound.

A developing agent used in the invention forms a color dye upon coupling with the coupler of the invention. The coupler has sites within the molecule which are capable of forming a bidentate or terdentate chelate with a metal ion, so that the developing agent does not necessitate any chelating site. Thus, conventionally-used developing agents are usable, therefore, it is advantageous in cost.

The coupler of the invention can be incorporated in a silver halide emulsion according to the method, as known in the art. The coupler, for example, is dissolved in an organic high boiling solvent having a boiling point of 175° C. or higher such as tricresyl phosphate or dibutyl phthalate or a low boiling solvent such as butyl acetate or butyl propionate and the resulting solution is mixed with an aqueous gelatin solution containing a surfactant. The mixture is emulsified by means of a high-speed rotating mixer or colloid mill and thereafter added to a silver halide emulsion used in the invention.

The composition of silver halide used in a photographic light sensitive material containing the coupler of the invention comprises silver chloride, silver chlorobromide or silver chloroiodobromide. It may be a combined mixture of silver chloride and silver bromide. In the case where a silver halide emulsion is applied to a color print paper, rapid developability is required and, with respect to the composition of silver halide, it is preferable to contain chloride. Accordingly, silver chloride, or silver chlorobromide or silver chloroiodobromide containing 1 mol% or more of silver chloride.

The silver halide emulsion used in the invention is chemically sensitized according to conventional methods. The silver halide emulsion can be spectrally sensitized to a desired wavelength region.

An antifogging agent or stabilizer may be incorporated in the silver halide emulsion for the purpose of preventing fogging during the course of manufacture, storage and processing of a photographic light sensitive material, and stabilize photographic performance.

In a color photographic light sensitive material containing the coupler of the invention are usable an anticolor-staining agent, dye image stabilizer, UV absorbent, antistatic agent, matting agent and surfactant, as used in convention a photographic light sensitive material. These are referred to, for example, Research Disclosure 176 22–31 (Dec., 1978).

The color photographic light sensitive material of invention is color-developed according to the method known in the art. A developing agent or its precursor may be incorporated in a hydrophilic colloid layer of the photographic material, which can be processed in an alkaline activator bath.

The color photographic light sensitive material is, after color development, subjected to bleaching and fixing. Bleaching and fixing may be conducted at the same time. After fixing, washing is carried out. Stabilizing may be conducted instead of washing, or both processing may be conducted.

Another preferred embodiment of forming a metal-chelated image of the invention is to incorporate a metal ion-containing compound in a photographic light sensitive material. The metal ion compound may be incorporated in a layer containing the coupler of the invention or adjacent layer thereto. The metal ion compound maybe water soluble or oil soluble. When the coupler is oil soluble, the metal ion compound be preferably oil soluble and, similarly to the case of the coupler, it is dissolved in a high boiling solvent to be added. In this case, the photographic light sensitive material can be subjected to conventional color photographic processing. It is therefore advantageous that a stable image can be obtained according to the same processing method as in convention photographic materials.

EXAMPLES

Embodiments of the present invention will be explained as below, but the invention is not limited thereto.

EXAMPLE 1

On a paper support laminated on both sides with polyethylene, the following layers are coated in this order from the side of the support to prepare a red-sensitive color photographic light sensitive material sample 1.

The addition amount of a compound is denoted as the amount per $m^2$, unless otherwise noted. The amount of silver halide is one converted to silver.

1st layer: Emulsion layer

Red-sensitive layer comprising gelatin of 1.2 g, a red-sensitive silver bromochloride emulsion (chloride: 99.5 mol%) of 0.35 g, coupler I-8 ($7.5\times10^{-4}$ mol) dissolved in a high boiling solvent (DOP) of 0.50 g and metal ion donating compound MS-9 ($4\times10^{-4}$).

2nd layer: Protective layer

Protective layer containing gelatin of 0.5 g. A hardener, H-1 was added in an amount of 0.017 g/g gelatin.

Inventive samples 2 to 8 and comparative samples 9 to 11 were prepared in the same manner as sample 1, except that the coupler was replaced by an equimolar amount of a metal-chelated coupler, as shown in Table 1.

DOP: Dioctyl phosphate
H-1: 2,4-Dichloro-6-hydroxy-s-triazine sodium salt

Coupler a

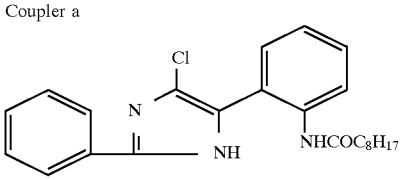

Coupler b

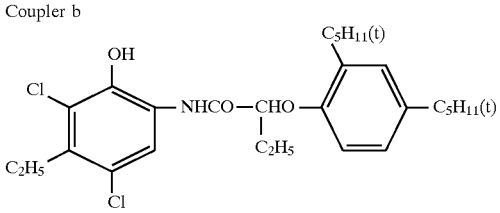

Coupler c

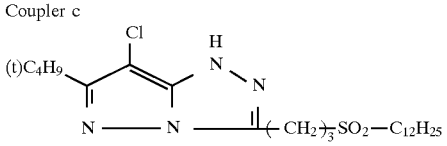

Samples 1 to 11 were exposed through an optical wedge and processed according to the following steps.

| Processing step | Temperature | Time |
|---|---|---|
| Color developing | 35.0 ± 0.3° C. | 45 sec. |
| Bleach-fixing | 35.0 ± 0.5° C. | 45 sec. |
| Stabilizing | 30° C. to 34° C. | 90 sec. |
| Drying | 60° C. to 80° C. | 60 sec. |

Composition of a processing solution used in each processing step is as follows.

| Color developer | |
|---|---|
| Water | 800 cc |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-Hydroxyethylidene-1,1-disulfonic acid | 1.0 g |
| Ethylenediaminetetraacetic acid | 1.0 g |
| Disodium catechol-3,5-disulfonate | 1.0 g |
| Diethylene glycol | 10 g |
| 3-Methyl-4-amino-N-ethyl-N-(β-methanesufonamidoethyl)aniline sulfate | 4.5 g |
| Fluorescent brightener (4,4',-diaminostylbene-disulfonic acid derivative) | 1.0 g |
| Potassium carbonate | 27 g |

Water was added to make 1 liter and the pH was adjusted to 10.20.

| Bleach-fixer | |
|---|---|
| Ammonium ferric ethylenediaminetetra-acetate dihydride | 60.0 g |
| Ethylenediaminetetraacetic acid | 3.0 g |
| Ammonium thiosulfate (70% aq. solution) | 100.0 cc |
| Ammonium sulfite (40% aq. solution) | 27.5 cc |

Water was added to make 1 liter and the pH was adjusted to 5.7 with potassium carbonate or glacial acetic acid.

| Stabilizer | |
|---|---|
| 5-Chloro-2-methyl-4-isothiazoline-3-one | 0.2 g |
| 1,2-Benzisothiazoline-3-one | 0.3 g |
| Ethylene glycol | 1.0 g |
| 1-hydroxyethylidene-1,1-diphosphonicacid | 2.0 g |
| o-Phenylphenol sodium salt | 1.0 g |
| Ethylenediaminetetraacetic acid | 1.0 g |
| Ammonium hydroxide (20% aq. solution) | 3.0 g |
| Fluorescent brightener (4,4'-diaminostylbene-disulfonic acid derivative) | 1.5 g |

Water was added to make 1 liter and the pH was adjusted to 7.0 with sulfuric acid or potassium hydroxide.

Thus-processed samples 1 to 11 were subjected to sensitometry using a densitometer (Type KD-7, produced by Konica). Further, the processed samples were aged over a period of 14 days under hot humid conditions (60° C., 80% R.H.) to evaluate heat and humidity fastness of a dye image. Furthermore, the processed samples were exposed xenon lamp over a period of 7 days to evaluate light fastness the dye image.

Results thereof are shown in Table 1, in which the heat fastness, humidity fastness and light fastness of the dye image each are shown as a percentage of the residual image density, after respective fastness-tests with respect to an image, with a density 1.0 prior to the test, were conducted.

TABLE 1

| Sample No. | Coupler | Maximum density | Heat fastness | Humidity fastness | Light fastness |
|---|---|---|---|---|---|
| 1 (Inv) | I-8 | 2.8 | 94 | 89 | 95 |
| 2 (Inv) | II-12 | 2.7 | 95 | 94 | 93 |
| 3 (Inv) | III-2 | 2.5 | 93 | 92 | 94 |
| 4 (Inv) | IV-2 | 2.4 | 93 | 91 | 93 |
| 5 (Inv) | V-4 | 2.1 | 89 | 88 | 96 |
| 6 (Inv) | VI-1 | 2.0 | 90 | 90 | 92 |
| 7 (Inv) | VII-1 | 2.3 | 87 | 86 | 89 |
| 8 (Inv) | VIII-1 | 2.5 | 89 | 89 | 87 |
| 9 (Comp) | a | 1.6 | 60 | 58 | 20 |
| 10 (Comp) | b | 1.8 | 90 | 89 | 35 |
| 11 (Comp) | c | 1.5 | 92 | 80 | 72 |

As can be seen from Table 1, samples containing an inventive coupler were high in a residual dye ratio and less susceptible to fading even when placed under hot humid conditions, as compared to samples containing a comparative coupler. The light fastness was also improved.

EXAMPLE 2

Samples 1A to 8A were prepared in the same manner as Samples 1 to 8 of Example 1, respectively, except for the elimination of the metal ion-donating compound. For comparison, samples 9 to 11 were used. A metal chelating bath having the following composition was prepared. The samples were processed in the same manner as in Example, and then were immersed in the metal chelating bath for 5 min. (21° C.), washed for 3 10 min. (30° C.) and dried.

Thus processed samples were subjected to sensitometry and evaluated in the same manner as in Example 1. Results thereof are shown in Table 2.

TABLE 2

| Nickel chelating bath | |
|---|---|
| Nickel sulfate heptahydride | 10 g |
| Water | 180 cc |
| 0.8% $NH_3$ aqueous solution | 2.32 g |

| Sample No. | Coupler | Maximum density | Heat fastness | Humidity fastness | Light fastness |
|---|---|---|---|---|---|
| 1A (Inv) | I-8 | 2.7 | 93 | 87 | 93 |
| 2A (Inv) | II-12 | 2.5 | 93 | 92 | 91 |
| 3A (Inv) | III-2 | 2.4 | 94 | 90 | 94 |
| 4A (Inv) | IV-2 | 2.3 | 93 | 91 | 90 |
| 5A (Inv) | V-4 | 2.2 | 89 | 89 | 94 |
| 6A (Inv) | VI-1 | 2.1 | 91 | 90 | 92 |
| 7A (Inv) | VII-1 | 2.3 | 87 | 87 | 91 |
| 8A (Inv) | VIII-1 | 2.3 | 88 | 86 | 88 |
| 9 (Comp) | a | 1.6 | 60 | 58 | 21 |
| 10 (Comp) | b | 1.8 | 90 | 89 | 34 |
| 11 (Comp) | c | 1.5 | 92 | 80 | 73 |

EXAMPLE 3

Samples were prepared in a manner similar to Example 1, provided that a metal ion donating compound and coupler was varied, as shown in Table 3. These samples were evaluated in the same manner as in Example 1. Results thereof are shown in Table 3.

TABLE 3

| Sample No. | Metal ion donating compound | Coupler | Maximum density | Heat fastness | Humidity fastness | Light fastness |
|---|---|---|---|---|---|---|
| 21 (Inv) | MS-8 | I-8 | 2.7 | 93 | 88 | 92 |
| 22 (Inv) | MS-8 | I-13 | 2.5 | 90 | 89 | 91 |
| 23 (Inv) | MS-22 | I-16 | 2.4 | 91 | 88 | 90 |
| 24 (Inv) | MS-5 | I-20 | 2.4 | 88 | 85 | 89 |
| 25 (Inv) | MS-8 | II-3 | 2.3 | 92 | 90 | 88 |
| 26 (Inv) | MS-8 | II-12 | 2.5 | 95 | 92 | 92 |
| 27 (Inv) | MS-8 | III-2 | 2.4 | 94 | 90 | 94 |
| 28 (Inv) | MS-8 | IV-2 | 2.4 | 93 | 91 | 92 |
| 29 (Inv) | MS-8 | V-4 | 2.0 | 87 | 85 | 93 |
| 30 (Inv) | MS-8 | VI-1 | 2.1 | 91 | 90 | 92 |
| 31 (Inv) | MS-12 | I-8 | 2.6 | 93 | 88 | 85 |
| 32 (Inv) | MS-13 | I-8 | 2.4 | 90 | 82 | 80 |
| 33 (Inv) | MS-19 | I-8 | 2.3 | 89 | 87 | 81 |
| 34 (Inv) | MS-8 | VIII-1 | 2.2 | 90 | 91 | 91 |
| 35 (Comp) | MS-8 | a | 1.6 | 60 | 60 | 23 |
| 36 (Comp) | MS-8 | b | 1.7 | 85 | 80 | 67 |
| 37 (Comp) | MS-8 | c | 1.5 | 84 | 81 | 68 |

EXAMPLE 4

The samples were prepared in the same manner as those of Example 1 and evaluated in the same manner as in Example 1, except that a developing agent (3-Methyl-4-amino-N-ethyl-N-(β-methane-sufonamidoethyl) aniline sulfate) was replaced by an equal amount by weight of 3-amino-6-diethylamino-2-methylpyridine sulfate. Results thereof are shown in Table 4.

TABLE 4

| Sample No. | Coupler | Maximum density | Heat fastness | Humidity fastness | Light fastness |
|---|---|---|---|---|---|
| 41 (Inv) | I-8 | 2.9 | 95 | 90 | 96 |
| 42 (Inv) | II-12 | 2.8 | 97 | 93 | 94 |
| 43 (Inv) | III-2 | 2.4 | 93 | 92 | 95 |
| 44 (Inv) | IV-2 | 2.5 | 95 | 90 | 95 |
| 45 (Inv) | V-4 | 2.3 | 91 | 88 | 96 |
| 46 (Inv) | VI-1 | 2.1 | 90 | 90 | 94 |
| 47 (Inv) | VII-1 | 2.2 | 89 | 87 | 92 |
| 48 (Inv) | VIII-1 | 2.3 | 89 | 86 | 91 |
| 49 (Comp) | a | 1.5 | 65 | 60 | 25 |
| 50 (Comp) | b | 1.7 | 91 | 88 | 40 |
| 51 (Comp) | c | 1.5 | 90 | 81 | 75 |

As can be seen from Table 1, samples containing an inventive coupler were high in a residual dye ratio and less susceptible to fading even when placed under hot humid conditions, as compared to samples containing a comparative coupler. The light fastness also improved.

EXAMPLE 5

Samples 41A to 48A were prepared in the same manner as Samples 41 to 48 of Example 4, respectively, except for the elimination of the metal ion-donating compound. For comparison, samples 49 to 51 were used. A metal chelating bath having the following composition was prepared in the same manner as in Example 2. The samples were processed in the same manner as in Example, and then were immersed in the metal chelating bath for 5 min. (21° C.), washed for 3 10 min. (30° C.) and dried. Results thereof are shown in Table 5.

TABLE 5

| Sample No. | Coupler | Maximum density | Heat fastness | Humidity fastness | Light fastness |
|---|---|---|---|---|---|
| 41A (Inv) | I-8 | 2.6 | 94 | 86 | 92 |
| 42A (Inv) | II-12 | 2.4 | 94 | 91 | 90 |
| 43A (Inv) | III-2 | 2.4 | 96 | 89 | 93 |
| 44A (Inv) | IV-2 | 2.5 | 93 | 90 | 91 |
| 45A (Inv) | V-4 | 2.3 | 91 | 89 | 92 |
| 46A (Inv) | VI-1 | 2.4 | 90 | 88 | 90 |
| 47A (Inv) | VII-1 | 2.3 | 88 | 87 | 91 |
| 48A (Inv) | VIII-1 | 2.4 | 87 | 88 | 90 |
| 49 (Comp) | a | 1.5 | 62 | 55 | 20 |
| 50 (Comp) | b | 1.7 | 88 | 87 | 36 |
| 51 (Comp) | c | 1.4 | 90 | 81 | 70 |

EXAMPLE 6

Samples were prepared in a manner similar to Example 4, provided that a metal ion donating compound and coupler was varied, as shown in Table 6. These samples were evaluated in the same manner as in Example 4. Results thereof are shown in Table 6.

TABLE 6

| Sample No. | Metal ion donating compound | Coupler | Maximum density | Heat fastness | Humidity fastness | Light fastness |
|---|---|---|---|---|---|---|
| 61 (Inv) | MS-8 | I-8 | 2.8 | 95 | 87 | 94 |
| 62 (Inv) | MS-8 | I-13 | 2.6 | 93 | 87 | 94 |
| 63 (Inv) | MS-22 | I-16 | 2.5 | 94 | 86 | 92 |
| 64 (Inv) | MS-5 | I-20 | 2.5 | 90 | 83 | 91 |
| 65 (Inv) | MS-8 | II-3 | 2.3 | 95 | 87 | 90 |

TABLE 6-continued

| Sample No. | Metal ion donating compound | Coupler | Maximum density | Heat fastness | Humidity fastness | Light fastness |
|---|---|---|---|---|---|---|
| 66 (Inv) | MS-8 | II-12 | 2.6 | 94 | 88 | 92 |
| 67 (Inv) | MS-8 | III-2 | 2.5 | 93 | 86 | 94 |
| 68 (Inv) | MS-8 | IV-2 | 2.5 | 92 | 87 | 93 |
| 69 (Inv) | MS-8 | V-4 | 2.2 | 89 | 84 | 93 |
| 70 (Inv) | MS-8 | VI-1 | 2.3 | 92 | 86 | 94 |
| 71 (Inv) | MS-12 | I-8 | 2.7 | 93 | 85 | 87 |
| 72 (Inv) | MS-13 | I-8 | 2.6 | 92 | 80 | 84 |
| 73 (Inv) | MS-19 | I-8 | 2.4 | 91 | 85 | 86 |
| 74 (Inv) | MS-8 | VIII-1 | 2.4 | 90 | 84 | 93 |
| 75 (Comp) | MS-8 | a | 1.7 | 63 | 54 | 25 |
| 76 (Comp) | MS-8 | b | 1.6 | 86 | 76 | 70 |
| 77 (Comp) | MS-8 | c | 1.7 | 85 | 79 | 73 |

EXAMPLE 7

Sample 81 was prepared in the same manner as Sample 1 of Example 1, except that, in place of the coupler (I-8) and nickel donating compound (SM-9) was used a nickel-chelated coupler (chelate of I-8, as described in Synthetic Examples) of $7.5\times10^{-4}$ mol. Samples 82 to 87 were prepared in the same manner sample 81, except that the nickel-chelate of coupler I-8 was replaced by a metal chelate of a coupler as shown in Table 7 (Synthetic Examples) . For comparison, samples 9, 10 and 11 were also employed. These samples were subjected to exposure and processing and evaluated in the same manner as in Example 1. Results thereof are shown in Table 7.

TABLE 7

| Sample No. | Chelated coupler | Maximum density | Heat fastness | Humidity fastness | Light fastness |
|---|---|---|---|---|---|
| 81 (Inv) | I-8 | 2.8 | 94 | 89 | 95 |
| 82 (Inv) | II-12 | 2.7 | 95 | 94 | 93 |
| 83 (Inv) | III-2 | 2.5 | 93 | 92 | 94 |
| 84 (Inv) | IV-2 | 2.4 | 93 | 91 | 93 |
| 85 (Inv) | V-4 | 2.1 | 89 | 88 | 96 |
| 86 (Inv) | VI-1 | 2.0 | 90 | 90 | 92 |
| 87 (Inv) | VII-1 | 2.3 | 87 | 86 | 89 |
| 9 (Comp) | a | 1.6 | 60 | 58 | 20 |
| 10 (Comp) | b | 1.8 | 90 | 89 | 35 |
| 11 (Comp) | c | 1.5 | 92 | 80 | 72 |

As can be seen from Table 1, samples containing an inventive coupler were high in a residual dye ratio and less susceptible to fading even when placed under hot humid conditions, as compared to samples containing a comparative coupler. The light fastness also improved.

EXAMPLE 8

On a paper support laminated on one side thereof with polyethylene and laminated on another side with polyethylene containing titanium dioxide, the following layers were coated on the side of the titanium oxide containing polyethylene layer to prepare a multilayered silver halide color photographic light sensitive material sample 88.

A yellow coupler (Y-1) of 26.7 g, dye image stabilizer (ST-1) of 10.0 g, dye image stabilizer (ST-2) of 6.67 g, additive (HQ-1) of 0.67 g, antiirradiation dye (AI-3) and high boiling solvent (DNP) of 6.67 g was dissolved in ethyl acetate of 60 ml and the resulting solution was dispersed in 220 ml of an aqueous 10% gelatin solution containing 7 ml of a 20% surfactant (SU-1) solution to a yellow coupler emulsion. This emulsion was mixed with a blue-sensitive silver halide emulsion (containing 8.68 g of silver) which was prepared according to the condition described later, to prepare a coating solution for the fist layer.

Coating solutions for the second layer through the seventh layer were prepared in a manner similar to the coating solution for the first layer.

A hardener (H-1) was added to the second and fourth layers and hardener (H-2) was added to the seventh layer. As a coating aid, surfactants (SU-2) and (SU-3) were added to adjust the surface tension. The addition amount is represented in grams per $m^2$ of the photographic material, unless otherwise noted.

| | |
|---|---|
| Seventh layer (protective layer) | |
| Gelatin | 1.00 |
| DIDP | 0.005 |
| Additive (HQ-2) | 0.002 |
| Additive (HQ-3) | 0.002 |
| Additive (HQ-4) | 0.004 |
| Additive (HQ-5) | 0.02 |
| Compound (F-1) | 0.002 |
| Sixth layer (UV absorbing layer) | |
| Gelatin | 0.40 |
| UV absorbent (UV-1) | 0.10 |
| UV absorbent (UV-2) | 0.04 |
| UV absorbent (UV-3) | 0.16 |
| Additive (HQ-5) | 0.04 |
| DNP | 0.20 |
| PVP | 0.03 |
| Antiirradiation dye (AI-2) | 0.02 |
| Antiirradiation dye (AI-4) | 0.01 |
| Fifth layer (red-sensitive layer) | |
| Gelatin | 1.30 |
| Red-sensitive silver bromochloride emulsion (Em-R) | 0.21 |
| Cyan coupler (C-1) | 0.40 |
| Dye image stabilizer (ST-1) | 0.20 |
| additive (HQ-1) | 0.01 |
| HBS-1 | 0.20 |
| DOP | 0.20 |
| Fourth layer (UV absorbing layer) | |
| Gelatin | 0.94 |
| UV absorbent (UV-1) | 0.28 |
| UV absorbent (UV-2) | 0.09 |
| UV absorbent (UV-3) | 0.38 |
| Additive (HQ-5) | 0.10 |
| DNP | 0.40 |
| Third layer (green-sensitive layer) | |
| Gelatin | 1.40 |
| Green-sensitive silver bromochloride emulsion (Em-G) | 0.17 |
| Magenta coupler (M-1) | 0.23 |
| Dye image stabilizer (ST-3) | 0.20 |
| Dye image stabilizer (ST-4) | 0.17 |
| DIDP | 0.13 |
| DBP | 0.13 |
| Antiirradiation dye (AI-1) | 0.01 |
| Second layer (interlayer) | |
| Gelatin | 1.20 |
| Additive (HQ-2) | 0.03 |
| Additive (HQ-3) | 0.03 |
| Additive (HQ-4) | 0.05 |
| Additive (HQ-5) | 0.23 |
| DIDP | 0.06 |
| Compound (F-1) | 0.002 |
| First layer (blue-sensitive layer) | |
| Gelatin | 1.20 |
| Blue-sensitive silver bromochloride emulsion (Em-B) | 0.26 |

-continued
| | |
|---|---|
| Yellow coupler (Y-1) | 0.80 |
| Dye image stabilizer (ST-1) | 0.30 |
| Dye image stabilizer (ST-2) | 0.20 |
| Additive (HQ-1) | 0.02 |
| Antiirradiation dye (AI-3) | 0.01 |
-continued
| | |
|---|---|
| DNP | 0.20 |
| Support (polyethylene-laminated paper) | |
The amount of a silver halide emulsion is converted to that of silver.
Y-1
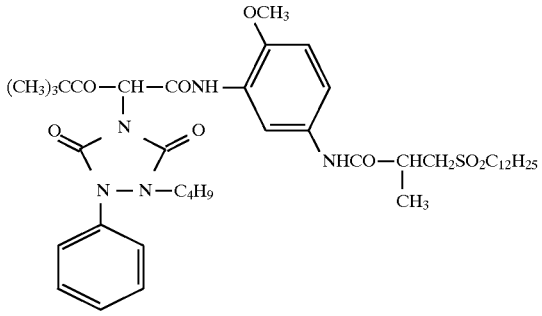
M-1
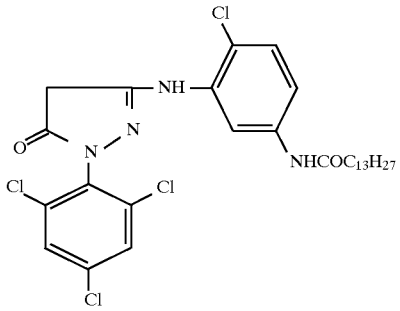
C-1
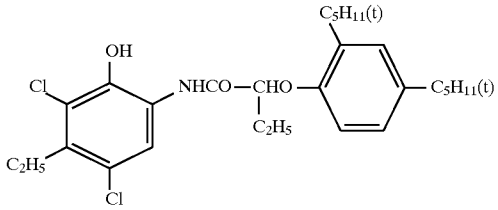
ST-1
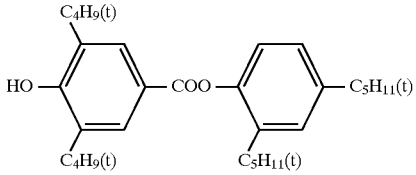
ST-2
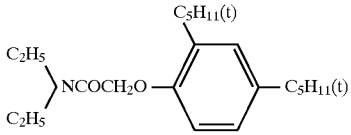
ST-3
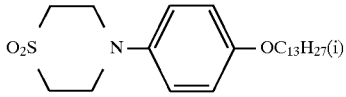

-continued
ST-4
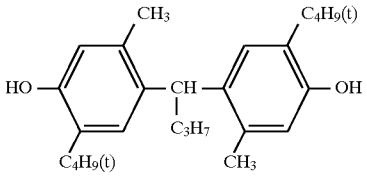
UV-1
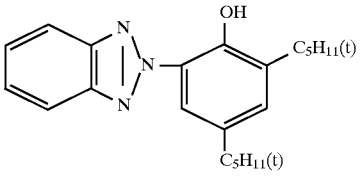
UV-2
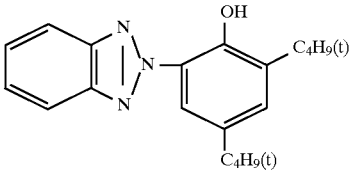
UV-3
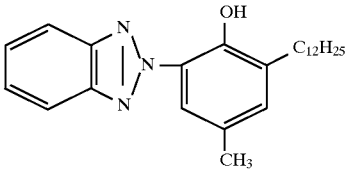
DBP: Dibutyl phthalate
DOP: Dioctyl phthalate
DNP: Dinonyl phthalate
DIDP: Diisodecylphthalate
PVP: Polyvinyl pyrrolidone
HQ-1
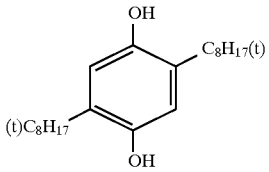
HQ-2
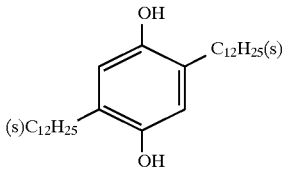
HQ-3
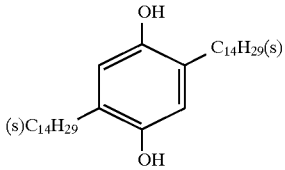
HQ-4
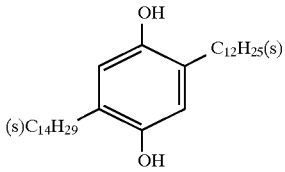

-continued
HQ-5
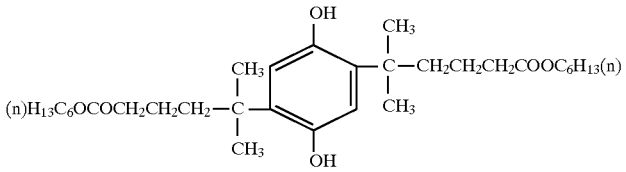
HBS-1
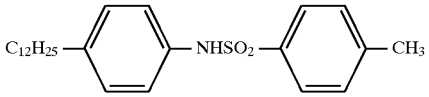
AI-1
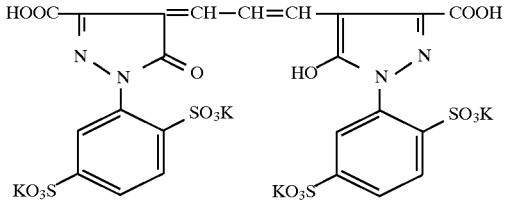
AI-2
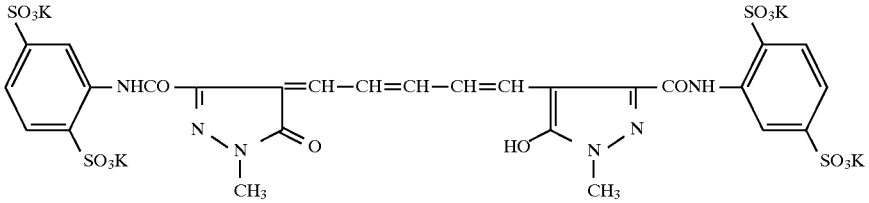
AI-3
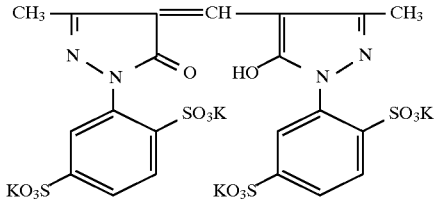
AI-4
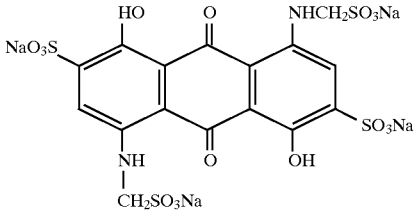
SU-1
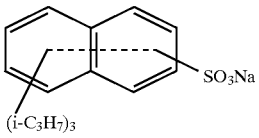
SU-2
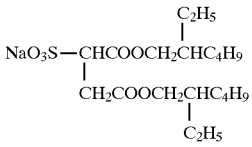
SU-3
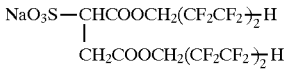
H-1

-continued

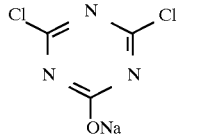

H-2

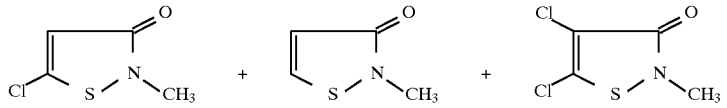

F-1

50% 46% 4% (Molar ratio)

Preparation of Blue-Sensitive Silver Halide Emulsion

To 1000 ml of n aqueous gelatin solution kept at 40° C., A-solution and B-solution were simultaneously added over a period of 30 min., while being maintained at a pAg of 6.5 and pH of 3.0, and further C-solution and D-solution were simultaneously added over a period of 30 min., while being maintained at a pAg of 6.5 and pH of 3.0

| | |
|---|---|
| A-solution | |
| Sodium chloride | 3.42 g |
| potassium bromide | 0.03 g |
| Water to make | 200 ml |
| B-solution | |
| Silver nitrate | 10 g |
| Water to make | 200 ml |
| C-solution | |
| Sodium chloride | 102.7 g |
| Potassium bromide | 1.0 g |
| Water to make | 600 ml |
| D-solution | |
| Silver nitrate | 300 g |
| Water to make | 600 ml |

After completing the addition, the emulsion was desalted by adding thereto an aqueous 5% solution of Demol (product of Kao-Atlas) and 2% magnesium sulfate aqueous solution. Then the emulsion was mixed with an aqueous gelatin solution to obtain a silver bromochloride emulsion (EMP-1) comprised of monodispersed cubic grains having an average grain size of 0.85 $\mu$m, a coefficient of variation (σ/F) of 0.07 and chloride content of 99.5 mol%.

The above emulsion (EMP-1) was chemically ripened at 50° C. for 90 min. by adding the following compounds to obtain a blue-sensitive silver halide emulsion (Em-B).

| | |
|---|---|
| Sodium thiosulfate | 0.8 mg/mol AgX |
| Chloroauric acid | 0.5 mg/mol AgX |
| Stabilizer STAB-1 | $6 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of Green-Sensitive Silver Halide Emulsion

A silver bromochloride emulsion (EMP-2) was prepared in the same manner as EMP-1, except that the addition time of A- and B-solutions and that of C- and D-solutions were respectively varied. The resulting emulsion was proved to be comprised of monodispersed cubic grains having an average grain size of 0.43 mm, a coefficient of variation (σ/F) of 0.08 and chloride content of 99.5 mol%.

The emulsion (EMP-2) was chemically ripened at 55° C. for 120 min. by adding the following compounds to obtain a green-sensitive silver halide emulsion (Em-G).

| | |
|---|---|
| Sodium thiosulfate | 1.5 mg/mol AgX |
| Chloroauric acid | 1.0 mg/mol AgX |
| Stabilizer STAB-1 | $6 \times 10^{-4}$ mol/mol AgX |
| Sensitizing dye GS-1 | $4 \times 10^{-4}$ mol/mol AgX |

Preparation of Red-Sensitive Silver Halide Emulsion

A silver bromochloride emulsion (EMP-3) was prepared in the same manner as EMP-1, except that the addition time of A- and B-solutions and that of C- and D-solutions were respectively varied. The resulting emulsion was proved to be comprised of monodispersed cubic grains having an average grain size of 0.50 mm, a coefficient of variation (σ/F) of 0.08 and chloride content of 99.5 mol%.

The emulsion (EMP-3) was chemically ripened at 60° C. for 90 min. by adding the following compounds to obtain a green-sensitive silver halide emulsion (Em-R).

| | |
|---|---|
| Sodium thiosulfate | 1.8 mg/mol AgX |
| Chloroauric acid | 2.0 mg/mol AgX |
| Stabilizer STAB-1 | $6 \times 10^{-4}$ mol/mol AgX |
| Sensitizing dye RS-1 | $1 \times 10^{-4}$ mol/mol AgX |

The coefficient of variation can be calculated from a standard deviation (σ) and average grain size (r), based on the following formula, $$\sigma=\{\Sigma(r_i-r)^2/\Sigma n_i\}^{1/2}$$

where $r^i$ represents a grain size and $n_1$ represents the number of grins having a grain size of $r_i$.

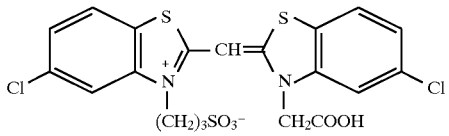

BS-1

-continued

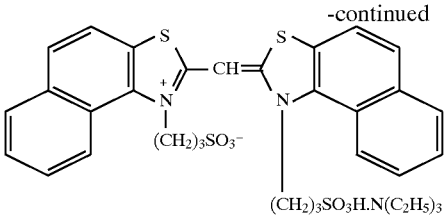

BS-2

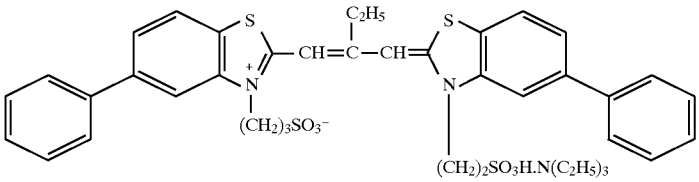

GS-1

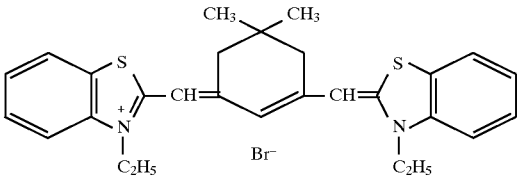

RS-1

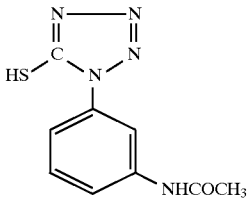

STAB-1

Samples 89 to 111 were prepared in the same manner as sample 88, except that a magenta coupler (M-1) contained in the third layer and cyan coupler (C-1) were replaced by an equimolar amount of a metal chelated couplers as shown in Table 8.

Samples were exposed and processed in the same manner as in Example 1. Thus-processed samples 1 to 11 were subjected to sensitometry using a densitometer (Type KD-7, produced by Konica). Further, the processed samples were aged over a period of 21 days under hot humid conditions (85 ° C., 60% R.H.) to evaluate heat and humidity fastness of a dye image. The heat fastness, humidity fastness and light fastness of the dye image each are shown as percentage of remained image density after each fastness-test with respect to an image with an initial density of 1.0.

Samples 88 to 111 were further evaluated with respect to color reproduction, according to the following method.

First, a Macbeth color checker was photographed using a color negative film (Konica Color LV-400: product by Konica) and a camera (Konica FT-1 Motor: product by Konica). Then, the photographed film was subjected to color-processing (CNK-4: product by Konica). The resulting negative image was printed on each of the above-described samples 88 to 111 to make a print, using a color printer (Konica Color Printer CL-P 2000: product by Konica). Printing of each sample was made under such a condition that neutral color of the color checker became neutral color on print.

Thus printed samples each were visually evaluated with respect to color reproduction. Results are shown in Table 8.

TABLE 8

| Sample | Third layer | | Fifth layer | | Dye residual ratio (%) | | Color reproduction** | | |
|---|---|---|---|---|---|---|---|---|---|
| No. | Coupler | Chelated metal | Coupler | Chelated metal | Magenta | Cyan | Red | Blue | Green |
| 88 (C)* | M-1 | None | C-1 | None | 75 | 81 | 3 | 3 | 3 |
| 89 (C) | M-1 | None | I-8 | None | 76 | 78 | 3 | 3 | 2 |
| 90 (C) | III-2 | None | C-1 | None | 77 | 82 | 3 | 3 | 3 |
| 91 (I)* | M-1 | None | I-8 | Ni | 81 | 93 | 3 | 4 | 4 |
| 92 (I) | M-1 | None | I-13 | Ni | 83 | 90 | 3 | 4 | 4 |
| 93 (I) | M-1 | None | I-16 | Ni | 82 | 92 | 3 | 4 | 4 |
| 94 (I) | M-1 | None | I-20 | Ni | 84 | 91 | 3 | 4 | 4 |
| 95 (I) | M-1 | None | VI-1 | Zn | 80 | 90 | 3 | 4 | 4 |
| 96 (I) | III-2 | None | I-8 | Ni | 80 | 89 | 4 | 4 | 4 |
| 97 (I) | II-12 | Ni | C-1 | None | 91 | 85 | 4 | 4 | 3 |
| 98 (I) | III-2 | Ni | C-1 | None | 91 | 89 | 4 | 4 | 3 |
| 99 (I) | IV-2 | Ni | C-1 | None | 90 | 87 | 4 | 4 | 3 |
| 100 (I) | V-4 | Ni | C-1 | None | 92 | 88 | 4 | 4 | 3 |

TABLE 8-continued

| Sample No. | Third layer Coupler | Third layer Chelated metal | Fifth layer Coupler | Fifth layer Chelated metal | Dye residual ratio (%) Magenta | Dye residual ratio (%) Cyan | Color reproduction** Red | Color reproduction** Blue | Color reproduction** Green |
|---|---|---|---|---|---|---|---|---|---|
| 101 (I) | VII-1 | Ni | C-1 | None | 93 | 86 | 4 | 4 | 3 |
| 102 (I) | II-12 | Ni | I-8 | Ni | 94 | 94 | 5 | 5 | 5 |
| 103 (I) | III-2 | Ni | I-8 | Ni | 93 | 91 | 5 | 5 | 5 |
| 104 (I) | IV-2 | Ni | I-8 | Ni | 92 | 93 | 5 | 5 | 5 |
| 105 (I) | V-4 | Ni | I-8 | Ni | 92 | 92 | 5 | 5 | 5 |
| 106 (I) | VII-1 | Ni | I-8 | Ni | 90 | 91 | 5 | 5 | 5 |
| 107 (I) | II-12 | Ni | VI-1 | Zn | 92 | 92 | 5 | 5 | 4 |
| 108 (I) | III-2 | Ni | VI-1 | Zn | 93 | 91 | 5 | 5 | 4 |
| 109 (I) | IV-2 | Ni | VI-1 | Zn | 91 | 92 | 5 | 5 | 4 |
| 110 (I) | V-4 | Ni | VI-1 | Zn | 92 | 90 | 5 | 5 | 4 |
| 111 (I) | VII-1 | Ni | VI-1 | Zn | 90 | 91 | 5 | 5 | 4 |

*C: Comparative I: Inventive
**Color reproduction was evaluated based on five grades of from 1 (poor) to 5 (excellent).

As can be seen from Table 8, inventive samples were shown to be high in the dye residual ratio and excellent in dye image fastness, as compared to comparative samples. The inventive samples were also shown to be excellent in color reproduction.

EXAMPLE 9

On a paper support laminated on one side thereof with polyethylene and on another side with a polyethylene containing titanium dioxide in an amount of 5% by weight and having a thickness of 110 μm, the following layers were coated to prepare a color photographic light sensitive material for use in color proof (sample 111).

Preparation of Silver Halide Emulsion (EM-1)

To a ossein gelatin aqueous solution maintained at 40° C., an ammoniacal silver nitrate aqueous solution and a halide aqueous solution (KBr:NaCl=95:5 in molar ratio) were simultaneously added by controlled double jet addition to prepare a core emulsion comprising silver chlorobromide cubic grains with an average size of 0.30 μm. During the course of the preparation, the pH and pAg were controlled so as obtain cubic grains. To the resulting core emulsion, an ammoniacal silver nitrate aqueous solution and a halide aqueous solution (KBr:NaCl=40:60 in molar ratio) were simultaneously added by controlled double jet addition to form a shell until the average grain size reached 0.42 μm. During the course of the preparation, the pH and pAg were controlled so as obtain cubic grains.

After the resulting emulsion was subjected to washing to remove soluble salts, gelatin was added thereto to obtain an emulsion EM-1. The width of grain size distribution of this emulsion was proved to be 8%.

Preparation of Silver Halide Emulsion (EM-2)

To a ossein gelatin aqueous solution maintained at 40° C., an ammoniacal silver nitrate aqueous solution and a halide aqueous solution (KBr:NaCl=95:5 in molarratio) were simultaneously added by controlled double jet addition to prepare a core emulsion comprising silver chlorobromide cubic grains with an average size of 0.18 μm. During the course of the preparation, the pH and pAg were controlled so as obtain cubic grains. To the resulting core emulsion, an ammoniacal silver nitrate aqueous solution and a halide aqueous solution (KBr:NaCl=40:60 in molar ratio) were simultaneously added by controlled double jet addition to form a shell until the average grain size reached 0.25 μm. During the course of the preparation, the pH and pAg were controlled so as obtain cubic grains.

After the resulting emulsion was subjected to washing to remove soluble salts, gelatin was added thereto to obtain an emulsion EM-2. The width of grain size distribution of this emulsion was proved to be 8%.

Preparation of Blue-Sensitive Emulsion EM-B

The emulsion EM-1 was spectrally sensitized by adding a sensitizing dye D-1 and then, T-1 of 600 mg was further added thereto to prepare a blue-sensitive emulsion EM-B.

Preparation of green-sensitive emulsion EM-G in the same manner as EM-B, except that a sensitizing dye D-2 was added to the emulsion EM-2.

Preparation of red-sensitive emulsion EM-R in the same manner as EM-B, except that a sensitizing dyes D-3 and D-4 were added to the emulsion EM-2.

Preparation of panchromatic emulsion EM-P in the same manner as EM-B, except that a sensitizing dyes D-1, D-2, D-3 and D-4 were added to the emulsion EM-1.

T-1: 4-hydroxy-6-methyl-1,3,3a,7-tetrazaindene

D-1

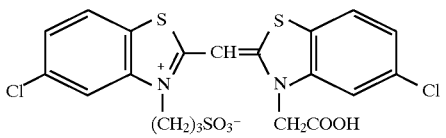

-continued

D-2

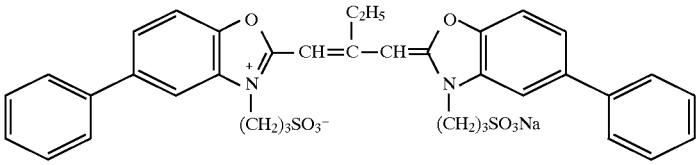

D-3

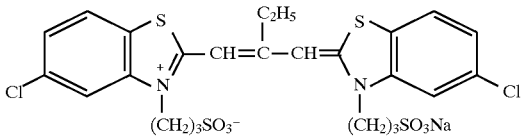

D-4

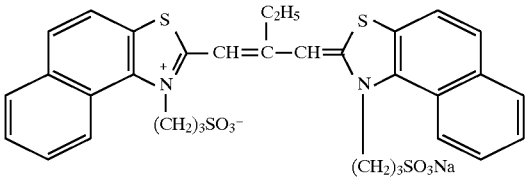

Using the above emulsions, EM-B, EM-G, EM-R and EM-P, was prepared a color photographic light sensitive material (sample 112) comprising the following layers. The 1st layer to the 8th layer were coated on one side of the support and the ninth layer was coated on the opposite side. As a coating aid, the following SA-1 and SA-2 were used and, as a hardener, H-1 and H-2 were used. The coating amount of silver halide was converted to a silver weight.

SA-1: Sodium di (2-ethylhexyl) sulfosuccinate SA-2: Sodium di (2,2,3,3,4,4,5,5-octafluoropentyl) sulfo-succinate H-1: Tetrakis (vinylsulfonylmethyl) methane H-2: 2,4-Dichloro-6-hydroxy-s-triazine sodium salt

| | |
|---|---|
| Eighth layer (UV absorbing layer) | |
| Gelatin | 0.78 (g/m$^2$) |
| UV absorbent (UV-1) | 0.065 |
| UV absorbent (UV-2) | 0.120 |
| UV absorbent (UV-3) | 0.160 |
| Solvent (SO-2) | 0.1 |
| Silica matting agent | 0.03 |
| Seventh layer (blue-sensitive layer) | |
| gelatin | 1.14 |
| Blue-sensitive emulsion (EM-B) | 0.40 |
| Yellow coupler (YC-1) | 0.656 |
| Antistaining agent (AS-2) | 0.02 |
| Solvent (SO-1) | 0.072 |
| Restraining agent (T-1, T-2, T-3) | |
| Sixth layer (interlayer) | |
| Gelatin | 0.54 |
| Anticolor-mixing agent (AS-1, 3, 4, 5 and 6; each, equal amount) | 0.055 |
| Solvent (SO-2) | 0.072 |
| Fifth layer (yellow colloidal silver layer) | |
| Gelatin | 0.42 |
| Yellow colloidal silver | 0.1 |
| Anticolor-mixing agent (AS-1, 3, 4, 5 and 6; each, equal amount) | 0.04 |
| Solvent (SO-2) | 0.049 |
| Polyvinyl pyrrolidone (PVP) | 0.047 |
| Antiirradiation dye (AI-7) | 0.03 |

-continued

| | |
|---|---|
| Fourth layer (interlayer) | |
| Gelatin | 0.54 |
| Anticolor-mixing agent (AS-1, 3, 4, 5 and 6; each, equal amount) | 0.055 |
| Solvent (SO-2) | 0.072 |
| Third layer (green-sensitive layer) | |
| Gelatin | 1.14 |
| Green-sensitive emulsion (EM-G) | 0.50 |
| Magenta coupler (MC-1) | 0.20 |
| Yellow coupler (YC-2) | 0.06 |
| Antistaining agent (AS-2) | 0.019 |
| Solvent (SO-1) | 0.31 |
| Restraining agent (T-1, T-2, T-3) | |
| Second layer (interlayer) | |
| Gelatin | 0.75 |
| Anticolor-mixing agent (AS-1, 3, 4, 5 and 6; each, equal amount) | 0.055 |
| Solvent (S)-2) | 0.072 |
| Antiirradiation dye (AI-5) | 0.01 |
| Antiirradiation dye (AI-6) | 0.01 |
| First layer (red-sensitive layer) | |
| Gelatin | 1.38 |
| Red-sensitive emulsion (EM-R) | 0.36 |
| Cyan coupler (CC-2) | 0.44 |
| Solvent (SO-1) | 0.31 |
| Antistaining agent (AS-2) | 0.015 |
| Restraining agent (T-1, T-2, T-3) | |
| Ninth layer (back side) | |
| Gelatin | 6.00 |
| Silica matting agent | 0.65 |

SO-1: Dibutyl phthalate
SO-2: Dioctyl phthalate
AS-1: 2,4-Di-t-octylhydroquinone
AS-2: 2,4-Di-t-butylhydroquinone
T-2: 1-(3-acetoamidophenyl)-5-mercaptotetrazole
T-3: N-benzyladenine -continued
UV-1
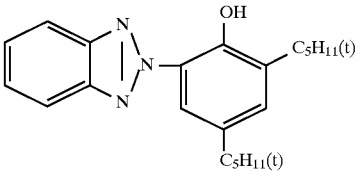
UV-2
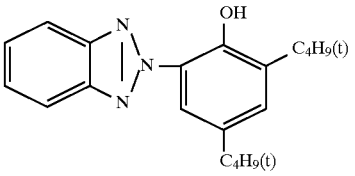
UV-3
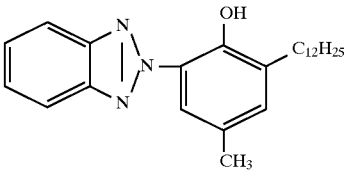
YC-1
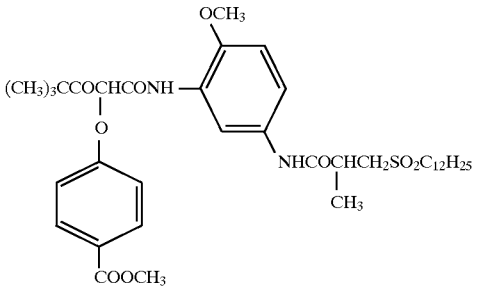
YC-2
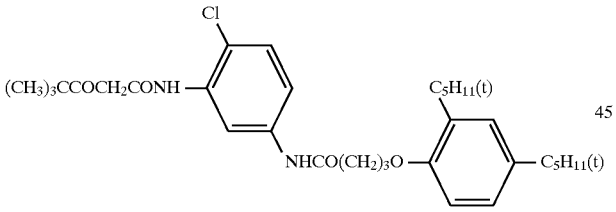
MC-1
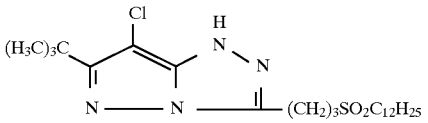
CC-2
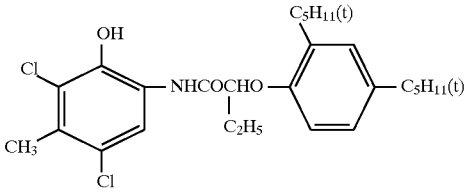
-continued
AI-5
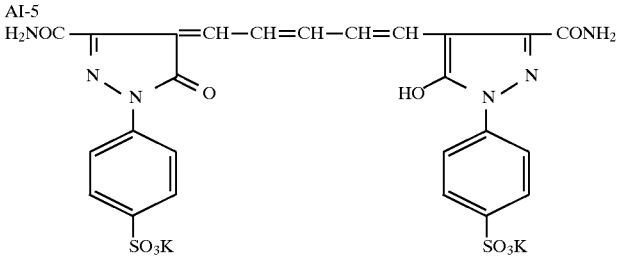
AI-6
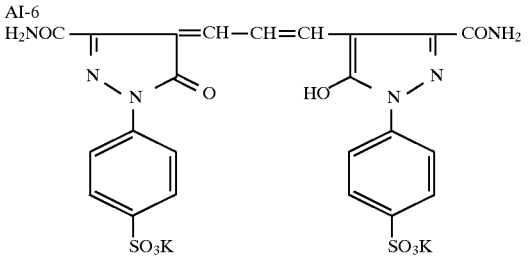
AI-7
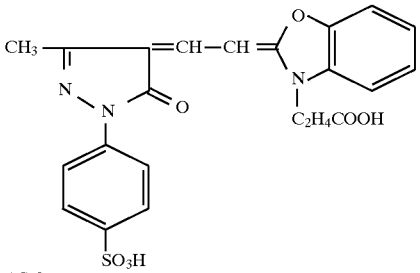
AS-3
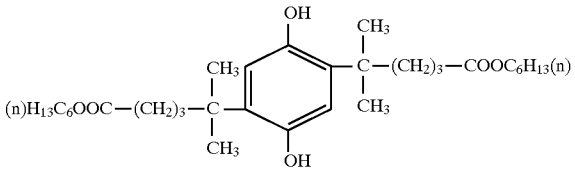
AS-4
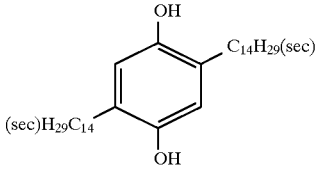
AS-5
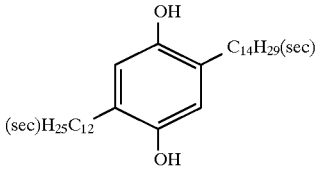
AS-6
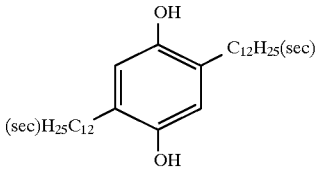

Samples 113 to 116 were prepared in the same manner as sample 112, except that the cyan coupler, CC-2 of the first layer was replaced by an equimolar amount of a chelated coupler of the invention.

Each of samples 112 to 116 was exposed to light under the following exposure condition-1 through a black image original and a cyan image original in contact therewith, then exposed to light under the following exposure condition-2 through a black image original and a magenta image original in contact therewith, and then further exposed to light under the following exposure condition-3 through a black image original and a yellow image original in contact therewith.

Exposure Condition-1

Each light-sensitive material was exposed through a red filter (Wratten No. 26) and an ND filter to a white light for 0.5 seconds at a minimum exposure giving a minimum value of red density after development by adjusting the density of the ND filter.

Exposure Condition-2

Each light-sensitive material was exposed through a green filter (Wratten No. 58) and an ND filter to a white light for 0.5 seconds at a minimum exposure giving a minimum value of green density after development by adjusting the density of the ND filter.

Exposure Condition-3

Each light-sensitive material was exposed through a blue filter (Wratten No. 47B) and an ND filter to a white light for 0.5 seconds at a minimum exposure giving a minimum value of blue density after development by adjusting the density of the ND filter.

The light source utilized for the above exposure conditions 1 to 3 was a daylight-type fluorescent lamp.

Exposed samples were processed according to the following processing condition-1 to obtain images.

Processing condition-1 Processing procedure-1 Temperature

| Time | | |
|---|---|---|
| Immersing in developing solution | 37° C. | 12 seconds |
| Light fogging | — | 12 seconds |
| Developing | 37° C. | 95 seconds |
| Bleach-fixing | 35° C. | 45 seconds |
| Stabilizing | 25–30° C. | 90 seconds |
| Drying | 60–85° C. | 40 seconds |

Compositions of the Processing Solutions

| (Color developing solution) | |
|---|---|
| Benzyl alcohol | 15.0 ml |
| Ceric sulfate | 0.015 g |
| Ethylene glycol | 8.0 ml |
| Potassium sulfite | 2.5 g |
| Potassium bromide | 0.6 g |
| Sodium chloride | 0.2 g |
| Potassium carbonate | 25.0 g |
| T-1 | 0.1 g |
| Hydroxylamine sulfate | 5.0 g |
| Sodium diethylenetriaminepentaacetate | 2.0 g |
| 4-amino-N-ethyl-N-(β-hydroxyethyl)aniline sulfate | 4.5 g |
| Brightening agent (4,4'-diaminostilbene-disulfonic acid derivative) | 1.0 g |
| Potassium hydroxide | 2.0 g |
| Diethylene glycol | 15.0 ml |

Water to make 1000 ml, pH adjusted to 10.15.

| Bleach-fixing solution | |
|---|---|
| Ferric ammonium diethylenetriaminepentaacetate | 90.0 g |
| Diethylenetriaminepentaacetate acid | 3.0 g |
| Ammonium thiosulfate (70% aqueous solution) | 180.0 ml |
| Ammonium sulfite (40% aqueous solution) | 27.5 ml |
| 3-mercapto-1,2,4-triazole | 0.15 g |

Adjust pH to 7.1 with potassium carbonate or glacial acetic acid, Water to make 1000 ml.

| Stabilizing solution | |
|---|---|
| O-Phenylphenol | 0.3 g |
| Potassium sulfite (50% aqueous solution) | 12 ml |
| Ethylene glycol | 10.0 g |
| 1-hydroxyethylidene-1,1-diphosphonic acid | 2.5 g |
| Bismuth chloride | 0.2 g |
| Zinc sulfate, heptahydrate | 0.7 g |
| Ammonium hydroxide (28% aqueous solution) | 2.0 g |
| Polyvinylpyrrolidone K-17 | 0.2 g |
| Brightening agent (4,4'-diaminostilbene-disulfonic acid derivative) | 2.0 g |

Water to make 1 liter.

Adjust pH to 7.5 with ammonium hydroxide or sulfuric acid.

Processed samples were subjected to sensitometry to determine a maximum density and minimum density of a cyan image. Further, a solid density portion of the cyan image of each sample was evaluated with respect to its closeness to printing ink.

TABLE 9

| Sample No. | Cyan coupler | Chelated metal | Maximum density | Minimum density | Color tone |
|---|---|---|---|---|---|
| 112 (C)* | CC-2 | None | 2.12 | 0.16 | C |
| 113 (I) | I-8 | Ni | 2.38 | 0.09 | B |
| 114 (I) | I-13 | Ni | 2.37 | 0.08 | B |
| 115 (I) | I-16 | Ni | 2.41 | 0.08 | B |
| 116 (I) | I-20 | Ni | 2.34 | 0.09 | B |
| 117 (I) | VI-1 | Zn | 2.35 | 0.10 | B |

*C: Comparative
I: Inventive
In the Table, the color tone of the cyan image was evaluated, based on the following grades:
A: Remarkably close to printing ink image
B: Close to printing ink image
C: Not usable as a color proof As can be seen from Table 9, inventive samples led to a cyan image with a high maximum density, low minimum density and excellent as a color proof, compared to comparative sample.

EXAMPLE 10

The samples of Example 9 were exposed, processed and evaluated in the same manner as in Example 9, except that a color developing agent, 4-amino-N-ethyl-N-(β-hydroxyethyl) aniline was replaced by PCD-1. Results thereof are shown in Table 10.

TABLE 10

| Sample No. | Cyan coupler | Chelated metal | Maximum density | Minimum density | Color tone |
|---|---|---|---|---|---|
| 112 (C)* | CC-2 | None | 2.06 | 0.18 | C |
| 113 (I) | I-8 | Ni | 2.31 | 0.10 | A |
| 114 (I) | I-13 | Ni | 2.32 | 0.09 | A |
| 115 (I) | I-16 | Ni | 2.31 | 0.08 | A |
| 116 (I) | I-20 | Ni | 2.30 | 0.10 | A |
| 117 (I) | VI-1 | Zn | 2.29 | 0.11 | A |

*C: Comparative I: Inventive

In the Table, the color tone of the cyan image was evaluated, based on the following grades:

A: Remarkably close to printing ink image

B: Close to printing ink image

C: Not usable as a color proof

PCD-1

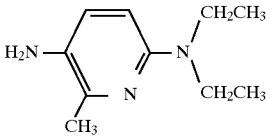

As can be seen from Table 9, inventive samples led to a cyan image with a high maximum density, low minimum density and excellent as a color proof, compared to comparative sample.

EXAMPLE 11

On a subbed triacetyl cellulose film support, the following layers were coated in this order to prepare multi-layered color photographic material samples 118 to 124.

The addition amount of a compound was denoted as grams per $m^2$ of the photographic material, unless otherwise noted. The amount of silver halide or colloidal silver was denoted as a converted amount to silver. The amount of a sensitizing dye is denoted as mol/mol of silver.

| | |
|---|---|
| First layer: Antihalation layer | |
| Black colloidal silver | 0.16 |
| UV absorbent (UV-1) | 0.20 |
| High boiling solvent (Oil-1) | 0.12 |
| Gelatin | 1.53 |
| Second layer: Interlayer | |
| antistaining agent (SC-1) | 0.06 |
| High boiling solvent (Oil-2) | 0.08 |
| Gelatin | 0.80 |
| Third layer: Low-speed red-sensitive layer | |
| Silver iodobromide emulsion (av. grain size of 0.38 μm, av. iodide of 8.0 mol %) | 0.43 |
| Silver iodobromide (av. grain size of 0.27 μm, av. iodide of 8.0 mol %) | 0.15 |
| Sensitizing dye (SD-1) | $2.0 \times 10^{-4}$ |
| Sensitizing dye (SD-2) | $1.9 \times 10^{-4}$ |
| Sensitizing dye (SD-3) | $1.9 \times 10^{-4}$ |
| Sensitizing dye (SD-4) | $1.0 \times 10^{-4}$ |
| Cyan coupler (as shown in Table 11) | 0.56 |
| Colored cyan coupler (CC-1) | 0.021 |
| DIR compound (DI-1) | 0.025 |
| High boiling solvent (Oil-1) | 0.49 |
| Gelatin | 1.14 |
| Fourth layer: Medium-speed red-sensitive layer | |
| Silver iodobromide emulsion (av. grain size of 0.52 μm, av. iodide of 8.0 mol %) | 0.89 |
| Silver iodobromide (av. grain size of 0.38 μm, av. iodide of 8.0 mol %) | 0.22 |
| Sensitizing dye (SD-1) | $2.3 \times 10^{-4}$ |

-continued

| | |
|---|---|
| Sensitizing dye (SD-2) | $1.2 \times 10^{-4}$ |
| Sensitizing dye (SD-3) | $1.6 \times 10^{-4}$ |
| Cyan coupler (as shown in Table 11) | 0.45 |
| Colored cyan coupler (CC-1) | 0.038 |
| DIR compound (DI-1) | 0.017 |
| High boiling solvent (Oil-1) | 0.39 |
| Gelatin | 1.01 |
| Fifth layer: High-speed red-sensitive layer | |
| Silver iodobromide emulsion (av. grain size of 1.00 μm, av. iodide of 8.0 mol %) | 1.27 |
| Sensitizing dye (SD-1) | $1.3 \times 10^{-4}$ |
| Sensitizing dye (SD-2) | $1.3 \times 10^{-4}$ |
| Sensitizing dye (SD-3) | $1.6 \times 10^{-4}$ |
| Cyan coupler (as shown in Table 11) | 0.20 |
| Colored cyan coupler (CC-1) | 0.034 |
| DIR compound (DI-3) | 0.001 |
| High boiling solvent (Oil-1) | 0.57 |
| Gelatin | 1.10 |
| Sixth layer: Interlayer | |
| Antistaining agent (SC-1) | 0.075 |
| High boiling solvent (Oil-2) | 0.095 |
| Gelatin | 1.00 |
| Seventh layer: Interlayer | |
| Gelatin | 0.45 |
| Eighth layer: Low-speed green-sensitive layer | |
| Silver iodobromide emulsion (av. grain size of 0.38 μm, av. iodide of 8.0 mol %) | 0.64 |
| Silver iodobromide (av. grain size of 0.27 μm, av. iodide of 2.0 mol %) | 0.21 |
| Sensitizing dye (SD-4) | $7.4 \times 10^{-4}$ |
| Sensitizing dye (SD-5) | $6.6 \times 10^{-4}$ |
| Magenta coupler (MM-1) | 0.19 |
| Magenta coupler (MM-2) | 0.49 |
| Colored magenta coupler (CM-1) | 0.12 |
| High boiling solvent (Oil-2) | 0.81 |
| Gelatin | 1.89 |
| Ninth layer: Medium-speed green-sensitive layer | |
| Silver iodobromide emulsion (av. grain size of 0.59 μm, av. iodide of 8.0 mol %) | 0.76 |
| Sensitizing dye (SD-6) | $1.5 \times 10^{-4}$ |
| Sensitizing dye (SD-7) | $1.6 \times 10^{-4}$ |
| Sensitizing dye (SD-8) | $1.5 \times 10^{-4}$ |
| Magenta coupler (MM-1) | 0.043 |
| Magenta coupler (MM-2) | 0.10 |
| Colored magenta coupler (CM-2) | 0.039 |
| DIR compound (D-2) | 0.021 |
| DIR compound (D-3) | 0.002 |
| High boiling solvent (Oil-2) | 0.37 |
| Gelatin | 0.76 |
| Tenth layer: High-speed green-sensitive layer | |
| Silver iodobromide emulsion (av. grain size of 1.00 μm, av. iodide of 8.0 mol %) | 1.46 |
| Sensitizing dye (SD-6) | $0.93 \times 10^{-4}$ |
| Sensitizing dye (SD-7) | $0.97 \times 10^{-4}$ |
| Sensitizing dye (SD-8) | $0.93 \times 10^{-4}$ |
| Magenta coupler (MM-1) | 0.08 |
| Magenta coupler (MM-2) | 0.133 |
| Colored magenta coupler (CM-1) | 0.014 |
| High boiling solvent (Oil-1) | 0.15 |
| High boiling solvent (Oil-2) | 0.42 |
| Gelatin | 1.08 |
| Eleventh layer: Yellow filter layer | |
| Yellow colloidal silver | 0.07 |
| Antistaining agent (SC-1) | 0.18 |
| Formaline scavenger (HS-1) | 0.14 |
| High boiling solvent (Oil-2)) | 0.21 |
| Gelatin | 0.73 |
| Twelfth layer: Interlayer | |
| Formaline scavenger (HS-1) | 0.18 |
| Gelatin | 0.60 |

-continued

| Thirteenth layer: Low-speed blue-sensitive layer | |
|---|---|
| Silver iodobromide emulsion (av. grain size of 0.50 μm, av. iodide of 8.0 mol %) | 0.073 |
| Silver iodobromide (av. grain size of 0.38 μm, av. iodide of 8.0 mol %) | 0.16 |
| Silver iodobromide emulsion (av. grain size of 0.27 μm, av. iodide of 2.0 mol %) | 0.20 |
| Sensitizing dye (SD-9) | $2.1 \times 10^{-4}$ |
| Sensitizing dye (SD-10) | $2.8 \times 10^{-4}$ |
| Yellow coupler (Y-2) | 0.89 |
| DIR compound (DI-4) | 0.008 |
| High boiling solvent (Oil-2) | 0.37 |
| Gelatin | 1.51 |
| **Fourteenth layer: High-speed blue-sensitive layer** | |
| Silver iodobromide emulsion (av. grain size of 1.00 μm, av. iodide of 8.0 mol %) | 0.95 |
| Sensitizing dye (SD-9) | $7.3 \times 10^{-4}$ |
| Sensitizing dye (SD-11) | $2.8 \times 10^{-4}$ |
| Yellow coupler (Y-2) | 0.16 |
| High boiling solvent (Oil-2) | 0.093 |
| Gelatin | 0.80 |

-continued

| Fifteenth layer: First protective layer | |
|---|---|
| Silver iodobromide emulsion (av. grain size; 0.05 μm, iodide; 3.0 mol %) | 0.30 |
| UV absorbent (UV-4) | 0.094 |
| UV absorbent (UV-5) | 0.10 |
| Formaline scavenger (HS-1) | 0.38 |
| High boiling solvent (Oil-1) | 0.10 |
| Gelatin | 1.44 |
| **Sixteenth layer: Second protective layer** | |
| Alkali-soluble matting agent PM-1 (av. particle size 2 μm) | 0.15 |
| Polymethyl methacrylate (av.size 3 μm) | 0.04 |
| Sliding agent (WAX-1) | 0.02 |
| Gelatin | 0.55 |

In addition to the above composition, a coating aid SU-4, dispersing aid SU-5, viscosity-adjusting agent, stabilizer T-1, dyes AI-8 and AI-9, antifoggant AF-1, polyvinyl pyrrolidone (AF-2) and antiseptic agent DF-1 were added.

A hardener was added to the second protective layer.

Chemical formulas of compounds described above are shown as below.

C-2

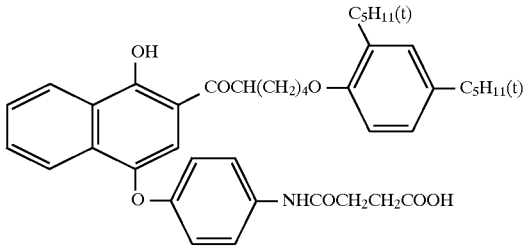

MM-1

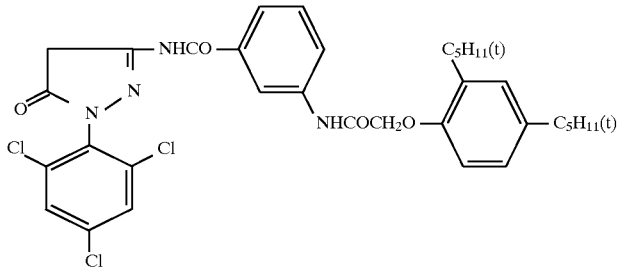

MM-2

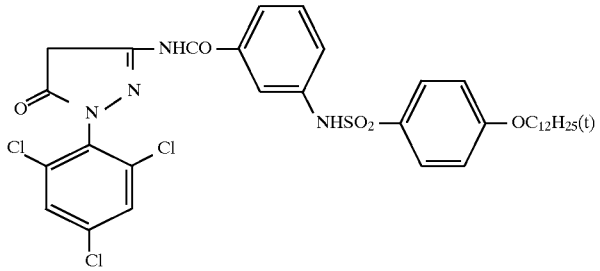

-continued
Y-2
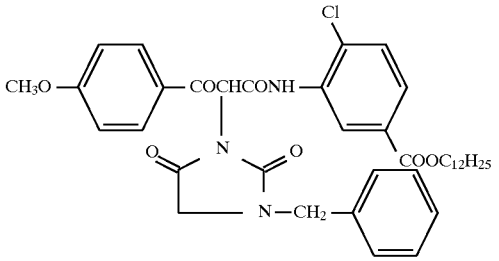
CC-1
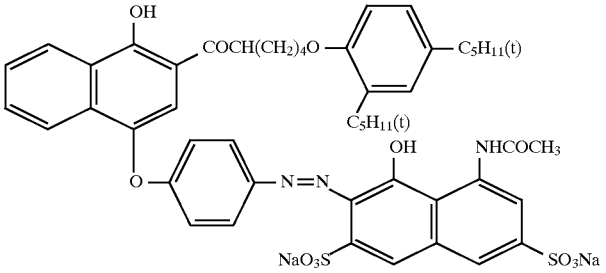
CM-1
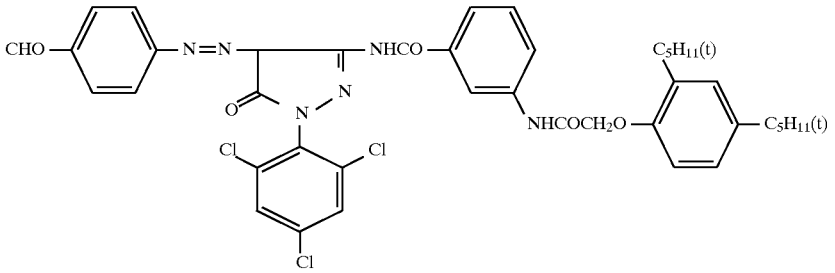
CM-2
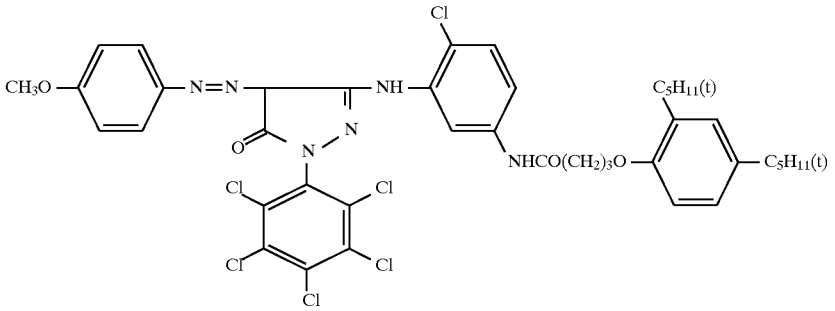
DI-1
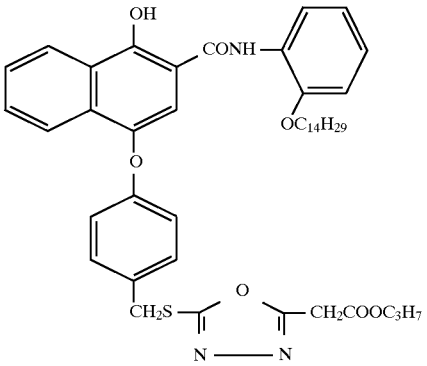

-continued
DI-2
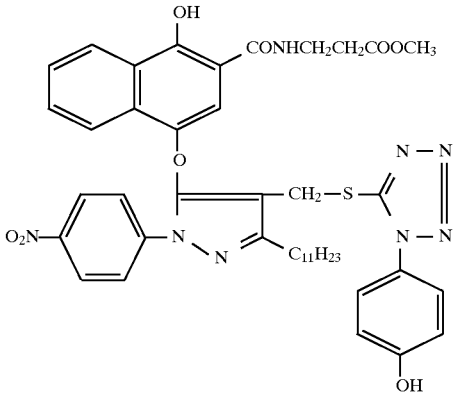
DI-3
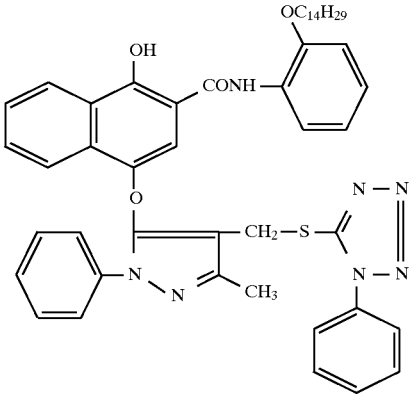
D-4
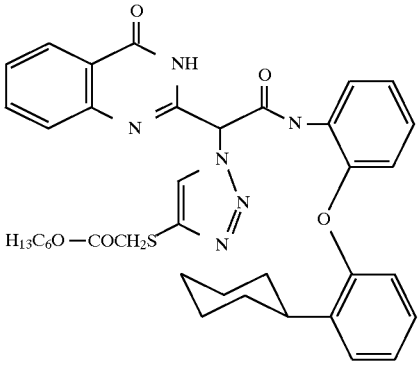
Oil-1
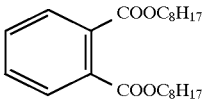
Oil-2
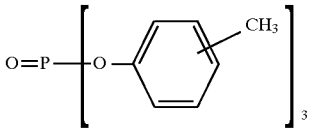
SC-1
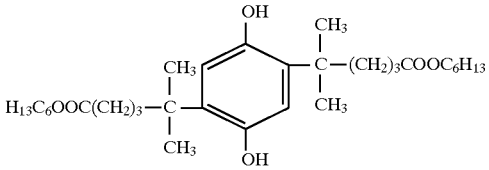

-continued
UV-4
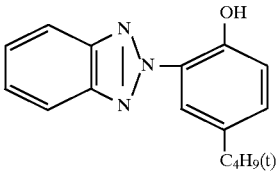
UV-5
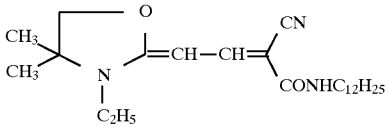
WAX-1
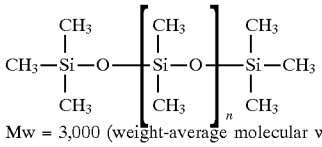
Mw = 3,000 (weight-average molecular weight)
SU-4
SU-4
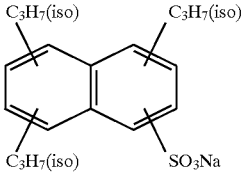
HS-1
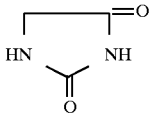
SD-1
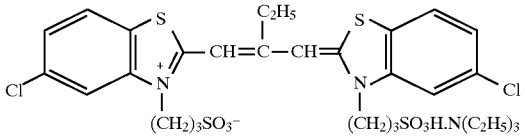
SD-2
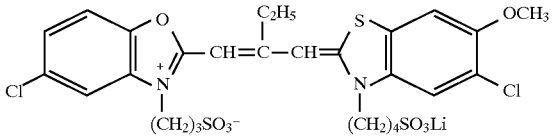
SD-3
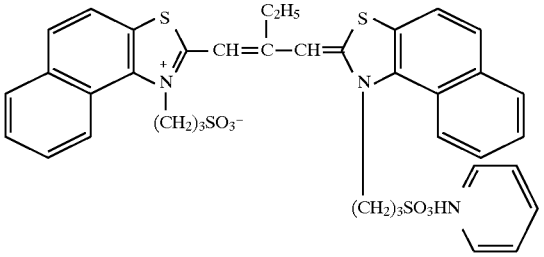
SD-4
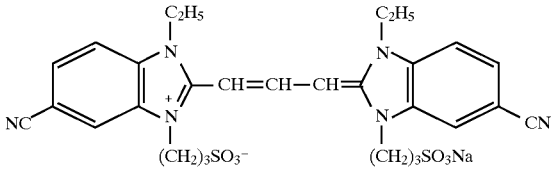

-continued
SD-5
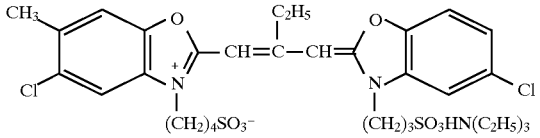
SD-6
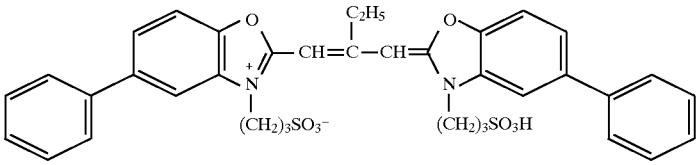
SD-7
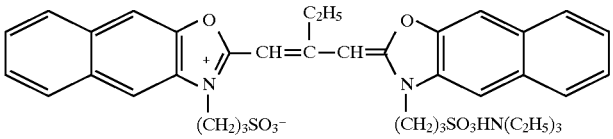
SD-8
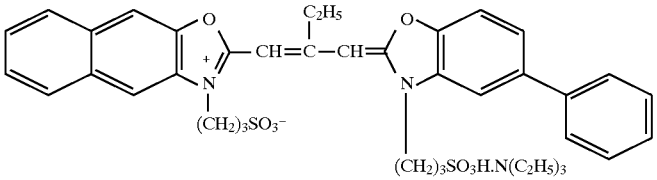
SD-9
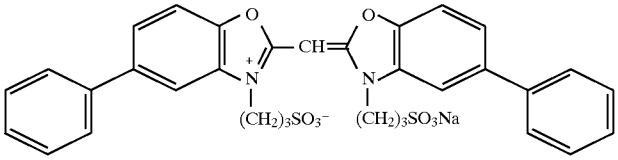
SD-9
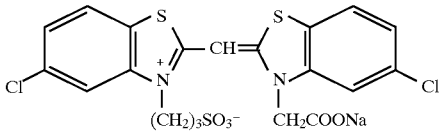
T-1
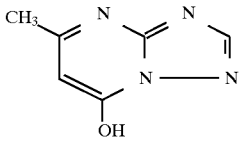
AF-1
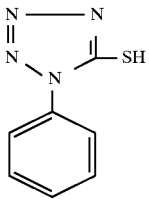
AF-2
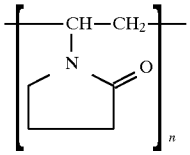
n: polymerization degree
(Mixture)
DF-1
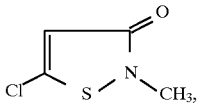
(Component A)
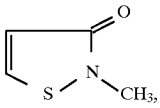
(Component B)
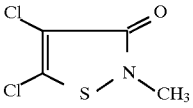
(Component C)

-continued

Component A:B:C = 50:46:4 (mole ratio)

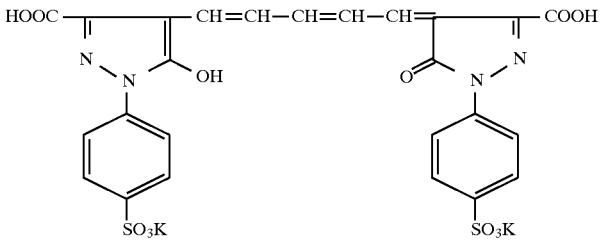

AI-8

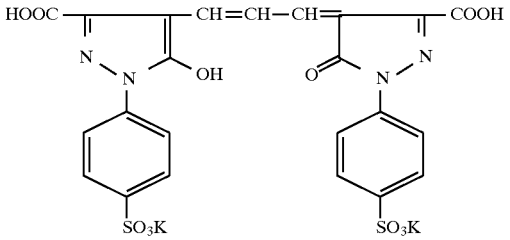

AI-9

Thus-prepared samples each were exposed to red light and processed according to the following process. Processed samples were aged for 14 days under hot humid conditions (75° C. and 80% RH) to make evaluation with respect to dye image fastness. The dye image fastness was determined, based a residual density ratio (%) of aged samples with respect to 1.5 of a density of fresh samples. results thereof are shown in Table 11.

| Step | Time | Temp. | Replenisher* |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 1 min. | 38 ± 5.0° C. | 830 ml |
| Drying | 1 min. | 55 ± 5.0° C. | — |

*Replenishing amount is expressed in ml per $m^2$.

Preparation of Processing Solutions

Color Developer and Replenisher thereof:

| | |
|---|---|
| Water | 800 ml |
| Potassium carbonate | 30 g |
| Sodium hydrogen carbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-Amino-3-methyl-N-(β-hydroxyethyl)-aniline sulfate | 4.5 g |
| Diethylenetriaminepentaacetic acid | 3.0 g |
| Potassium hydroxide | 1.2 g |

Water was added to make 1 liter in total, and the pH was adjusted to 10.06.

Color Developer-Replenishing Solution:

| | |
|---|---|
| Water | 800 ml |
| Potassium carbonate | 35 g |
| Sodium hydrogen carbonate | 3.0 g |
| Potassium sulfite | 5.0 g |
| Sodium bromide | 0.4 g |
| Hydroxylamine sulfate | 3.1 g |

-continued

| | |
|---|---|
| 4-Amino-3-methyl-N-(β-hydroxyethyl)-aniline sulfate | 6.3 g |
| Diethylenetriaminepentaacetic acid | 3.0 g |
| Potassium hydroxide | 2.0 g |

Water was added to make 1 liter and the pH was adjusted to 10.18.

Bleach:

| | |
|---|---|
| Water | 700 ml |
| Ammonium iron (III) 1,3-diamino-propanetetraacetic acid | 125 g |
| Ethylenediaminetetraacetic acid | 2 g |
| Sodium nitrate | 40 g |
| Ammonium bromide | 150 g |
| Glacial acetic acid | 40 g |

Water was added to make 1 liter in total and the pH of the bleach was adjusted to 4.4 with ammoniacal water or glacial acetic acid.

Bleach-Replenishing Solution:

| | |
|---|---|
| Water | 700 ml |
| Ammonium iron (III) 1,3-diamino-propanetetraacetic acid | 175 g |
| Ethylenediaminetetraacetic acid | 2 g |
| Sodium nitrate | 50 g |
| Ammonium bromide | 200 g |
| Glacial acetic acid | 56 g |

Water was added to make 1 liter in total and the pH was adjusted to 4.0 with ammoniacal water or glacial acetic acid.

Fixer:

| | |
|---|---|
| Water | 800 ml |
| Ammonium thiocyanate | 120 g |
| Ammonium thiosulfate | 150 g |
| Sodium sulfite | 15 g |
| Ethylenediaminetetraacetic acid | 2 g |

Water was added to make 1 liter in total and the pH was adjusted to 6.2 with ammoniacal water or glacial acetic acid.

Fixer-Replenishing Solution:

| | |
|---|---|
| Water | 800 ml |
| Ammonium thiocyanate | 150 g |
| Ammonium thiosulfate | 180 g |
| Sodium sulfite | 20 g |
| Ethylenediaminetetraacetic acid | 2 g |

Water was added to make 1 liter in total and the pH was adjusted to 6.5 with ammoniacal water or glacial acetic acid.

Stabilizer and Replenisher thereof:

| | |
|---|---|
| Water | 900 ml |
| p-Octylphenol/ethyleneoxide (10 mol) adduct | 2.0 g |
| Dimethylolurea | 0.5 g |
| Hexamethylenetetramine | 0.2 g |
| 1,2-benzoisothiazoline-3-one | 0.1 g |
| Siloxane (L-77, product by UCC) | 0.1 g |
| Ammoniacal water | 0.5 ml |

Water was added to make 1 liter in total and the pH thereof was adjusted to 8.5 with ammoniacal water or sulfuric acid (50%).

TABLE 11

| | Third, Fourth, Fifth layer | | Dye residual |
|---|---|---|---|
| Sample No. | Coupler | Chelated metal | ratio (%) |
| 118 (C) | C-2 | None | 68 |
| 119 (C) | I-8 | None | 62 |
| 120 (C) | I-13 | None | 58 |
| 121 (I) | I-8 | None | 92 |
| 122 (I) | I-13 | Ni | 91 |
| 123 (I) | I-16 | Ni | 93 |
| 124 (I) | VI-1 | Zn | 88 |

As can be seen from the Table, the inventive samples were proved to be high in dye residual ratio and excellent in dye fastness.

What is claimed is:

1. An image forming method comprising the steps of:

exposing a silver halide photographic light sensitive material comprising a support having thereon a silver halide emulsion layer containing a coupler and processing the exposed photographic material so that said coupler forms a chelate dye with a developing agent represented by formula (CD) or (PCD) and a metal ion, wherein said coupler has at least two sites chelating with said metal ion to form a 5-membered or 6-membered chelate ring, and the maximum absorption wavelength of said coupler shifts 5 nm or more upon chelation of said metal ion, formula (CD)

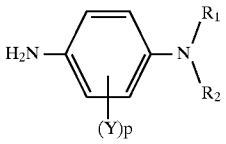

wherein $R_1$ and $R_2$ independently represent an alkyl group, Y represents a substituent, and p is an integer of 0 to 4;

formula (PCD)

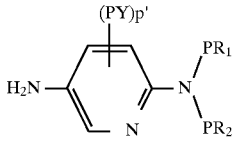

wherein $PR_1$ and $PR_2$ independently represent an alkyl group, PY represents a substituent, and p' is an integer of 0 to 4.

2. The image forming method of claim 1, wherein said silver halide emulsion layer or another layer contains a metal ion-providing material.

3. The image forming method of claim 1, wherein said silver halide emulsion layer contains said coupler in the form of a metal chelate.

4. The image forming method of claim 1, wherein said coupler is represented by formula (I), formula (I)

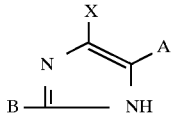

wherein A and B independently represent a substituent, provided that at least one of A and B is a chelating group capable of forming a chelate along with a metal ion; X represents a hydrogen atom or a group capable of being released upon coupling reaction with an oxidation product of a developing agent.

5. The image forming method of claim 1, wherein said coupler is represented by formula (II), formula (II)

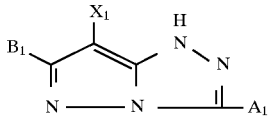

wherein $A_1$ and $B_2$ independently represent a substituent, provided that at least one of $A_1$ and $B_2$ is a chelating group capable of forming a chelate along with a metal ion; X represents a hydrogen atom or a group capable of being released upon coupling reaction with an oxidation product of a developing agent.

6. The image forming method of claim 1, wherein said coupler is represented by formula (III), formula (III)

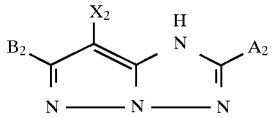

wherein $A_2$ and $B_2$ independently represent a substituent, provided that at least one of $A_2$ and $B_2$ is a chelating group capable of forming a chelate along with a metal ion; X represents a hydrogen atom or a group capable of being released upon coupling reaction with an oxidation product of a developing agent.

7. The image forming method of claim 1, wherein said coupler is represented by formula (IV),

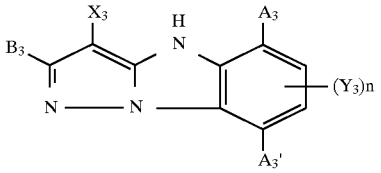

(formula IV)

wherein $A_3$, $A_3'$ and $B_3$ independently represent a substituent, provided that at least one of $A_3$, $A_3'$ and $B_3$ is a chelating group capable of forming a chelate along with a metal ion; $X_3$ represents a hydrogen atom or a group capable of being released upon coupling reaction with an oxidation product of a developing agent; $Y_3$ represents a substituent; n is an integer of 0 to 2.

8. The image forming method of claim 1, wherein said coupler is represented by formula (V),

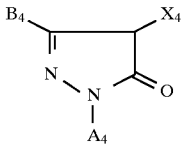

formula (V)

wherein $A_4$ and $B_4$ independently represent a substituent, provided that at least one of $A_4$ and $B_4$ is a chelating group capable of forming a chelate along with a metal ion; $X_4$ represents a hydrogen atom or a group capable of being released upon coupling reaction with an oxidation product of a developing agent.

9. The image forming method of claim 1, wherein said coupler is represented by formula (VI),

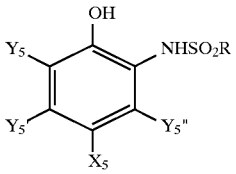

formula (VI)

wherein R represents an alkyl group, aryl group or heterocyclic group; $Y_5$, $Y_5'$ and $Y_5''$ independently represent a substituent and $Y_5$ and $Y_5'$ may be combined with each other to form a ring; $X_5$ represents a hydrogen atom or a group capable of being released upon coupling reaction with an oxidation product of a developing agent.

10. The image forming method of claim 1, wherein said coupler is represented by formula (VII),

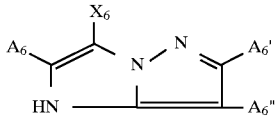

formula (VII)

wherein $A_6$, $A_6'$ and $A_6''$ independently represent a substituent, provided that at least one of $A_6$, $A_6'$ and $A_6''$ is a chelating group capable of forming a chelate along with a metal ion; $X_6$ represents a hydrogen atom or a group capable of being released upon coupling reaction with an oxidation product of a developing agent.

11. The image forming method of claim 1, wherein said coupler is represented by formula (VIII),

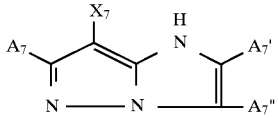

wherein $A_7$, $A_7''$ and $A_7''$ independently represent a substituent, provided that at least one of $A_7$, $A_7'$ and $A_7''$ is a chelating group capable of forming a chelate along with a metal ion; $X_7$ represents a hydrogen atom or a group capable of being released upon coupling reaction with an oxidation product of a developing agent.

12. The image forming method of claim 1, wherein said metal ion is an ion of a metal selected from aluminum, cobalt, chromium, copper, iron, magnesium, manganese, molybdenum, nickel, tin and zinc.

13. The image forming method of claim 12, wherein said metal ion is selected from $Ni^{2+}$, $Cu^{2+}$,$Cr^{2+}$, $Co^{2+}$ and $Zn^{2+}$.

14. The image forming method of claim 2, wherein said metal ion-providing material is a metal salt of a carboxylic acid, phosphoric acid or sulfonic acid, or a compound represented by the following formula (IX), formula (IX)

$$\{M(Q_1)s(Q_2)t(Q_3)u\}^{r+}(T-)r$$

wherein M represents a metal ion; $Q_1$, $Q_2$ and $Q_3$ independently represent a compound capable of forming a coordination bond with the metal ion represented by M; $T^-$ represents an organic anion; s, t, u each are an integer of 0 to 3, and r is 1 or 2.

15. The image forming method of claim 1, wherein said developing agent is represented by formula (CD).

16. The image forming method of claim 13, wherein said metal ion is $Ni^{2+}$.

* * * * *